US011796935B2

(12) United States Patent
Tonosu et al.

(10) Patent No.: US 11,796,935 B2
(45) Date of Patent: Oct. 24, 2023

(54) EXPOSURE DEVICE AND IMAGE FORMING APPARATUS

(71) Applicant: FUJIFILM Business Innovation Corp., Tokyo (JP)

(72) Inventors: Kenta Tonosu, Kanagawa (JP); Yosuke Kasuya, Kanagawa (JP); Takahiko Kobayashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/553,618

(22) Filed: Dec. 16, 2021

(65) Prior Publication Data

US 2023/0062126 A1 Mar. 2, 2023

(30) Foreign Application Priority Data

Aug. 25, 2021 (JP) ..... 2021-137616

(51) Int. Cl.
*G03G 15/04* (2006.01)

(52) U.S. Cl.
CPC ..... *G03G 15/04036* (2013.01)

(58) Field of Classification Search
CPC ..... G03G 15/04036
See application file for complete search history.

(56) References Cited

U.S. PATENT DOCUMENTS

2008/0145103 A1 6/2008 Honobe et al.

FOREIGN PATENT DOCUMENTS

| | | | | |
|---|---|---|---|---|
| JP | 2002361931 | | 12/2002 | |
| JP | 2005014497 | | 1/2005 | |
| JP | 2005022259 | | 1/2005 | |
| JP | 2006123474 A | * | 5/2006 | ..... B41J 2/471 |

OTHER PUBLICATIONS

English machine translation of Nakano (JP 2006-123474 A) (Year: 2006).*
"Search Report of Europe Counterpart Application", dated Oct. 4, 2022, pp. 1-8.

* cited by examiner

*Primary Examiner* — Walter L Lindsay, Jr.
*Assistant Examiner* — Geoffrey T Evans
(74) *Attorney, Agent, or Firm* — JCIPRNET

(57) ABSTRACT

An exposure device includes: at least one light emitter that includes a substrate and a light-emitting device disposed on the substrate; and a position adjuster that includes a contact member having an outer periphery in contact with the substrate, a support member that rotatably supports the contact member, and at least one mover that is in contact with the support member to move the support member in a light emission direction of the light emitter.

20 Claims, 16 Drawing Sheets

EXPOSURE DEVICE AND IMAGE FORMING APPARATUS

CROSS-REFERENCE TO RELATED APPLICATIONS

This application is based on and claims priority under 35 USC 119 from Japanese Patent Application No. 2021-137616 filed Aug. 25, 2021.

BACKGROUND

(i) Technical Field

The present disclosure relates to an exposure device and an image forming apparatus.

(ii) Related Art

Japanese Unexamined Patent Application Publication No. 2005-22259 discloses a focusing device of an optical write device that matches, with the surface of an image carrier, the focal point of light emitted from multiple light-emitting devices arranged in parallel in correspondence with pixels in the main scanning direction of the image forming area. The focusing device includes a storage member that stores a pattern image, an image forming member that forms an electrostatic latent image pattern corresponding to the pattern image stored in the storage member onto the surface of an image carrier, a surface-potential measuring member that measures the surface potential of the electrostatic latent image pattern area on the surface of the image carrier formed by the image forming member, and a position-changing mechanism that changes the position of an optical write device with respect to the surface of the image carrier to match the focal point of light from the light-emitting devices with the surface of the image carrier based on the surface potential measured by the surface-potential measuring member.

Japanese Unexamined Patent Application Publication No. 2005-14497 discloses an image forming apparatus including an image carrier, a light-emitting-diode (LED) print head disposed close to the surface of the image carrier to emit light to expose the image carrier to image information, a first positioning member fixed to a body of the image forming apparatus to support the image carrier, and a second positioning member disposed on the LED print head while being in contact with the first positioning member to restrict the distance between the image carrier and the LED print head. An elastic member is disposed between the second positioning member and the LED print head to urge the second positioning member in a predetermined direction away from the LED print head.

Japanese Unexamined Patent Application Publication No. 2002-361931 discloses an optical head positioning device that includes a cylindrical photoconductor drum extending in the longitudinal direction, an optical head extending in parallel with the photoconductor drum, and at least one spacer disposed in contact with the photoconductor drum to restrict the distance between the optical head and the surface of the photoconductor drum.

SUMMARY

Aspects of non-limiting embodiments of the present disclosure relate to an exposure device and an image forming apparatus capable of further reducing misregistration of a light emitter in a direction perpendicular to a light emission direction than a structure where a contact member is fixed to a support member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an exposure device including: at least one light emitter that includes a substrate and a light-emitting device disposed on the substrate; and a position adjuster that includes a contact member having an outer periphery in contact with the substrate, a support member that rotatably supports the contact member, and at least one mover that is in contact with the support member to move the support member in a light emission direction of the light emitter.

BRIEF DESCRIPTION OF THE DRAWINGS

Exemplary embodiments of the present disclosure will be described in detail based on the following figures, wherein.

DETAILED DESCRIPTION

An exemplary embodiment of the present disclosure (hereinafter referred to as an exemplary embodiment) will be described.

First Exemplary Embodiment

Image Forming Apparatus 10

Figure 1:
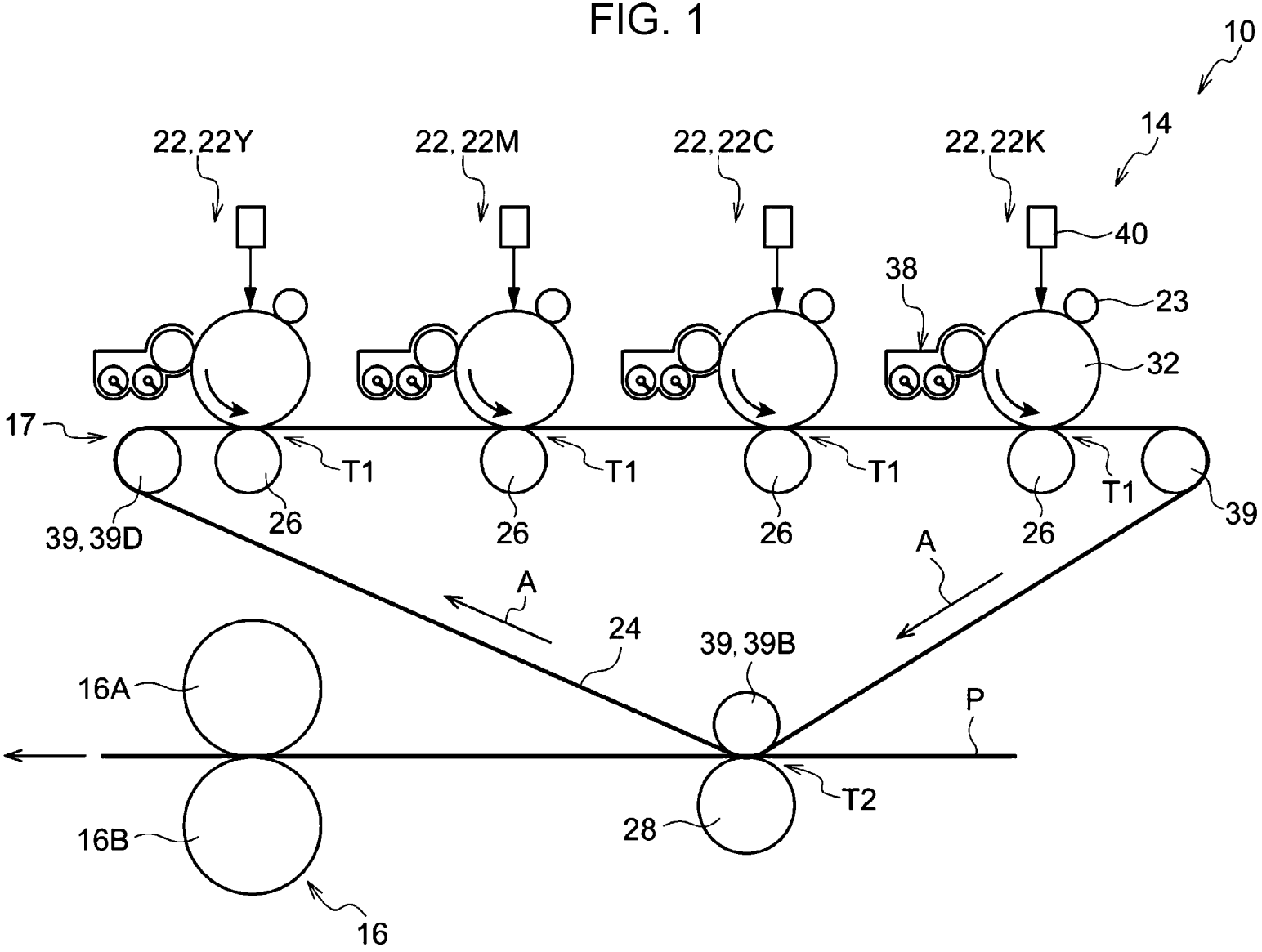
FIG. 1 is a schematic diagram of an image forming apparatus including an exposure device according to a first exemplary embodiment.

FIG. 1 is a schematic diagram of a structure of an image forming apparatus 10 including an exposure device 40 according to a first exemplary embodiment. The structure of the image forming apparatus 10 will be described first. Then, the exposure device 40 included in the image forming apparatus 10 will be described. The image forming apparatus 10 is, for example, an image forming apparatus forming images with multiple colors. An example of the image forming apparatus 10 is a full-color printer for commercial printing for which a particularly high image quality is desired.

The image forming apparatus 10 is a wide-image forming apparatus capable of handling media with a width exceeding the width of a recording medium P for B3 longitudinal feed (that is, the width exceeding 364 mm). For example, the image forming apparatus 10 handles recording media P of the size larger than or equal to 420 mm for A2 longitudinal feed and smaller than or equal to 1456 mm for B0 cross feed. For example, the image forming apparatus 10 handles recording media P of 728 mm for B2 cross feed.

The image forming apparatus 10 illustrated in FIG. 1 is an example of an image forming apparatus that forms images on recording media. More specifically, the image forming apparatus 10 is an electrophotographic image forming apparatus that forms toner images (an example of images) on the recording media P. Toner is an example of powder. More specifically, the image forming apparatus 10 includes an image forming unit 14 and a fixing device 16. Portions in the image forming apparatus 10 (the image forming unit 14 and the fixing device 16) will be described below.

Image Forming Unit 14

The image forming unit 14 has a function of forming toner images on the recording media P. More specifically, the image forming unit 14 includes toner image forming units 22 and a transfer device 17.

Toner Image Forming Units 22

The image forming unit 14 includes multiple toner image forming units 22 illustrated in FIG. 1 to form toner images of different colors. In the present exemplary embodiment, the image forming unit 14 includes the toner image forming units 22 for four colors of yellow (Y), magenta (M), cyan (C), and black (K). The letters Y, M, C, and K following the reference signs in FIG. 1 denote the colors to which the components correspond.

The toner image forming units 22 for the different colors have the same structure except for using different toner. Thus, in FIG. 1, components of the toner image forming unit 22K are denoted with reference sings as a representative of all the toner image forming units 22 for different colors.

More specifically, the toner image forming unit 22 for each color includes a photoconductor drum 32 that rotates in a first direction (for example, counterclockwise direction in FIG. 1). The photoconductor drum 32 is an example of an image carrier. The toner image forming unit 22 for each color also includes a charging device 23, the exposure device 40, and a developing device 38.

In the toner image forming unit 22 for each color, the charging device 23 electrically charges the photoconductor drum 32. The exposure device 40 exposes the photoconductor drum 32 electrically charged by the charging device 23 with light to form an electrostatic latent image on the photoconductor drum 32. The developing device 38 develops the electrostatic latent image formed on the photoconductor drum 32 by the exposure device 40 to form a toner image.

The photoconductor drum 32 rotates while carrying the electrostatic latent image formed in the above manner on the outer periphery to transport the electrostatic latent image to the developing device 38. A specific structure of the exposure device 40 will be described later.

Transfer Device 17

The transfer device 17 illustrated in FIG. 1 is a device that transfers toner images formed by the toner image forming units 22 onto the recording media P. More specifically, the transfer device 17 first-transfers the toner images on the photoconductor drums 32 for different colors to a transfer belt 24 serving as an intermediate transfer body in a superposed manner, and second-transfers the superposed toner images to a recording medium P. More specifically, as illustrated in FIG. 1, the transfer device 17 includes the transfer belt 24, first transfer rollers 26, and a second transfer roller 28.

Each first transfer roller 26 is a roller that transfers the toner image on the photoconductor drum 32 for the corresponding color to the transfer belt 24 at a first transfer position T1 between the photoconductor drum 32 and the first transfer roller 26. In the present exemplary embodiment, an application of a first-transfer electric field between the first transfer roller 26 and the photoconductor drum 32 transfers the toner image formed on the photoconductor drum 32 to the transfer belt 24 at the first transfer position T1.

The transfer belt 24 receives the toner image from each photoconductor drum 32 for the corresponding color on the outer peripheral surface. More specifically, the transfer belt 24 has the following structure. As illustrated in FIG. 1, the transfer belt 24 has an annular shape, and is wound around multiple rollers 39 to have its position fixed.

The transfer belt 24 rotates in the direction of arrows A with, for example, a driving roller 39D of multiple rollers 39 being driven to rotate by a driving unit (not illustrated). Among the multiple rollers 39, a roller 39B illustrated in FIG. 1 is an opposing roller 39B opposing the second transfer roller 28.

The second transfer roller 28 is a roller that transfers the toner image transferred to the transfer belt 24 to the recording medium P at a second transfer position T2 between the opposing roller 39B and the second transfer roller 28. In the present exemplary embodiment, an application of a second-transfer electric field between the opposing roller 39B and the second transfer roller 28 transfers the toner image transferred to the transfer belt 24 to the recording medium P at the second transfer position T2.

Fixing Device 16

The fixing device 16 illustrated in FIG. 1 is a device that fixes the toner image transferred to the recording medium P by the second transfer roller 28 to the recording medium P. More specifically, as illustrated in FIG. 1, the fixing device 16 includes a heating roller 16A serving as a heating member and a pressing roller 16B serving as a pressing member. The fixing device 16 heats and presses the recording medium P with the heating roller 16A and the pressing roller 16B to fix the toner image formed on the recording medium P to the recording medium P.

Exposure Device 40

Figure 2:
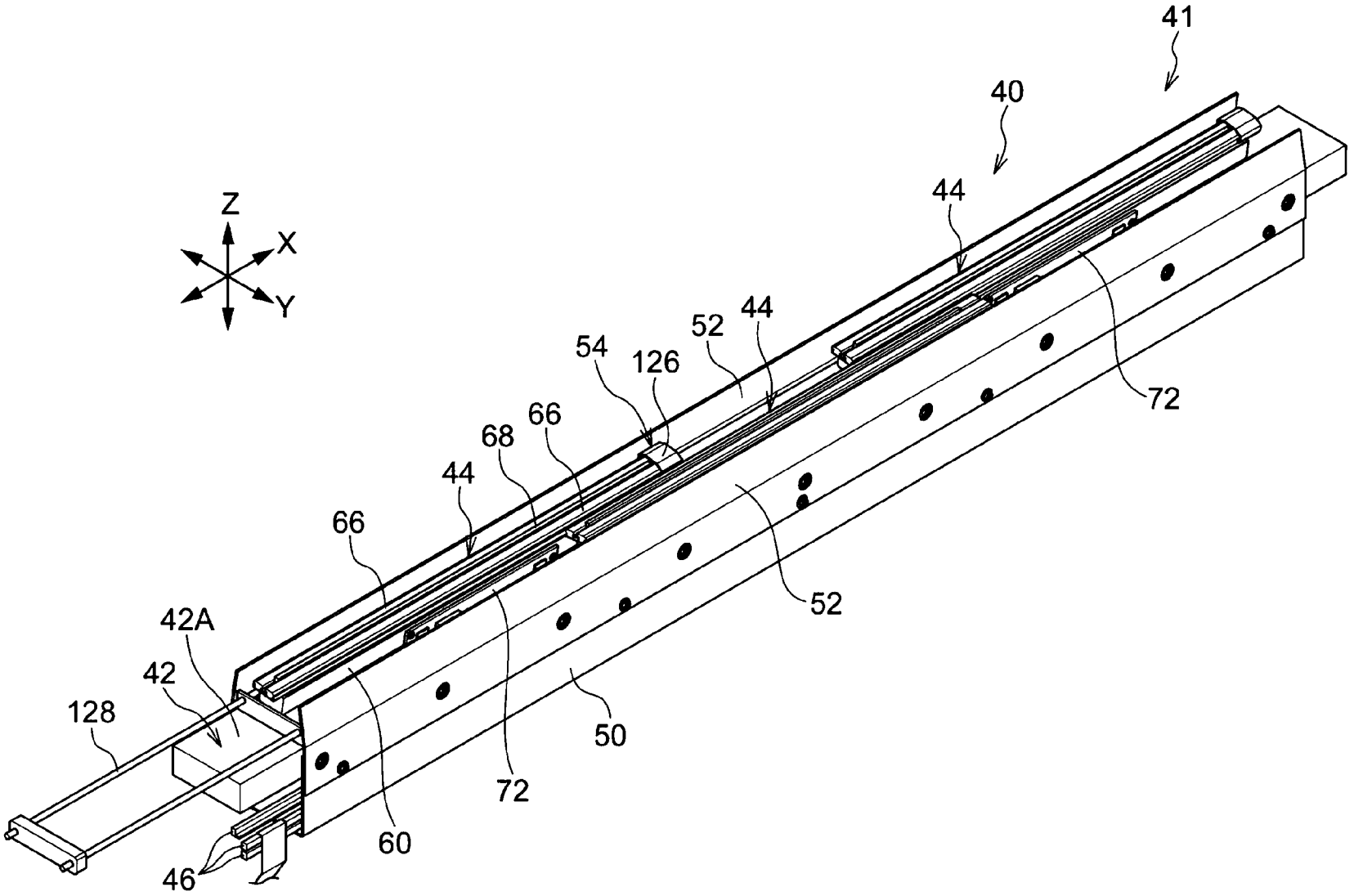
FIG. 2 is a perspective view of an exposure device included in the image forming apparatus.
Figure 3:
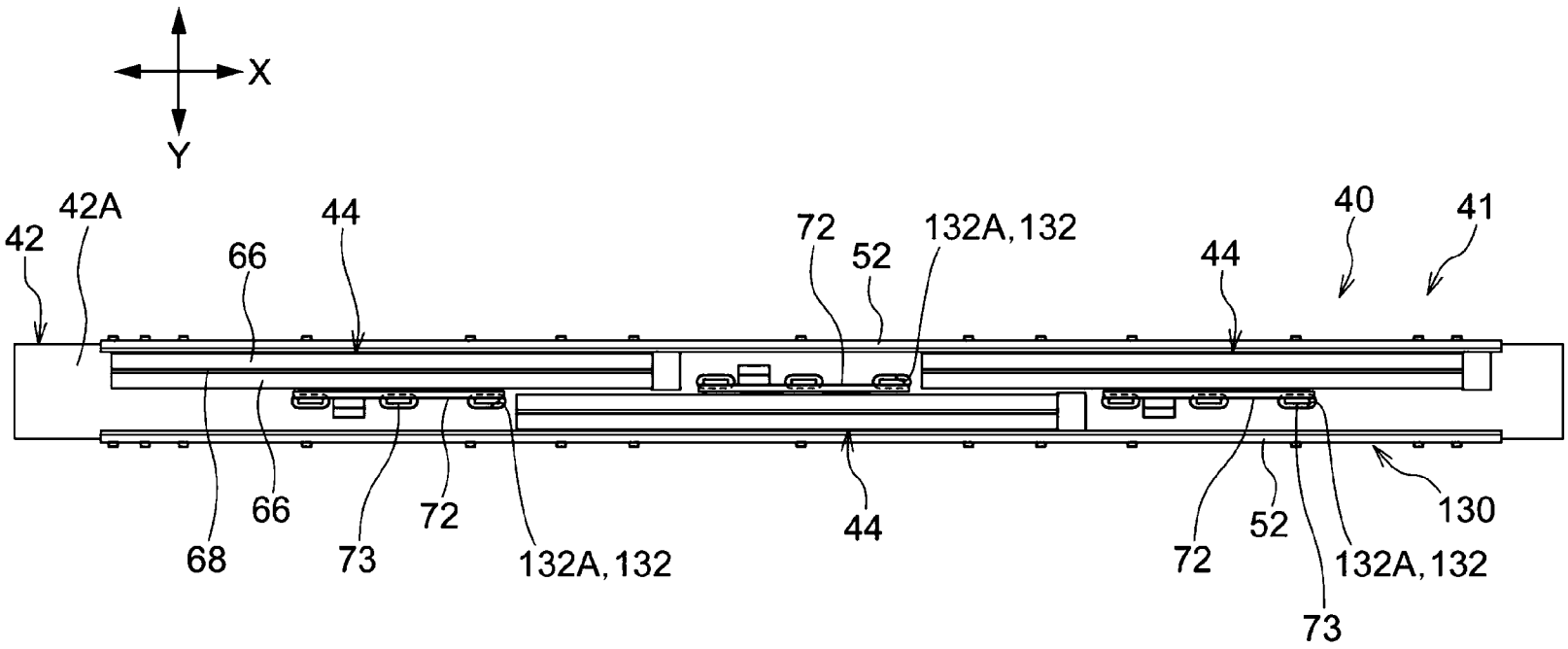
FIG. 3 is a diagram of a structure of the exposure device viewed in a vertical direction.

Subsequently, the structure of the exposure device 40 according to exemplary embodiments will be described. FIG. 2 is a perspective view of the structure of the exposure device 40. FIG. 3 is a plan view of the exposure device 40 viewed in the vertical direction. In the following description, the direction of arrow Y in the drawings indicates the width direction of the exposure device 40, and the direction of arrow Z indicates the height direction of the exposure device 40. The direction of arrow X perpendicular to the apparatus width direction and the apparatus height direction indicates the depth direction of the exposure device 40. The width direction and the height direction are merely defined for illustration convenience, and not used to limit the structure of the exposure device 40.

The entire structure of the exposure device 40 will be described first, and then components of the exposure device 40 will be described.

Figure 10:
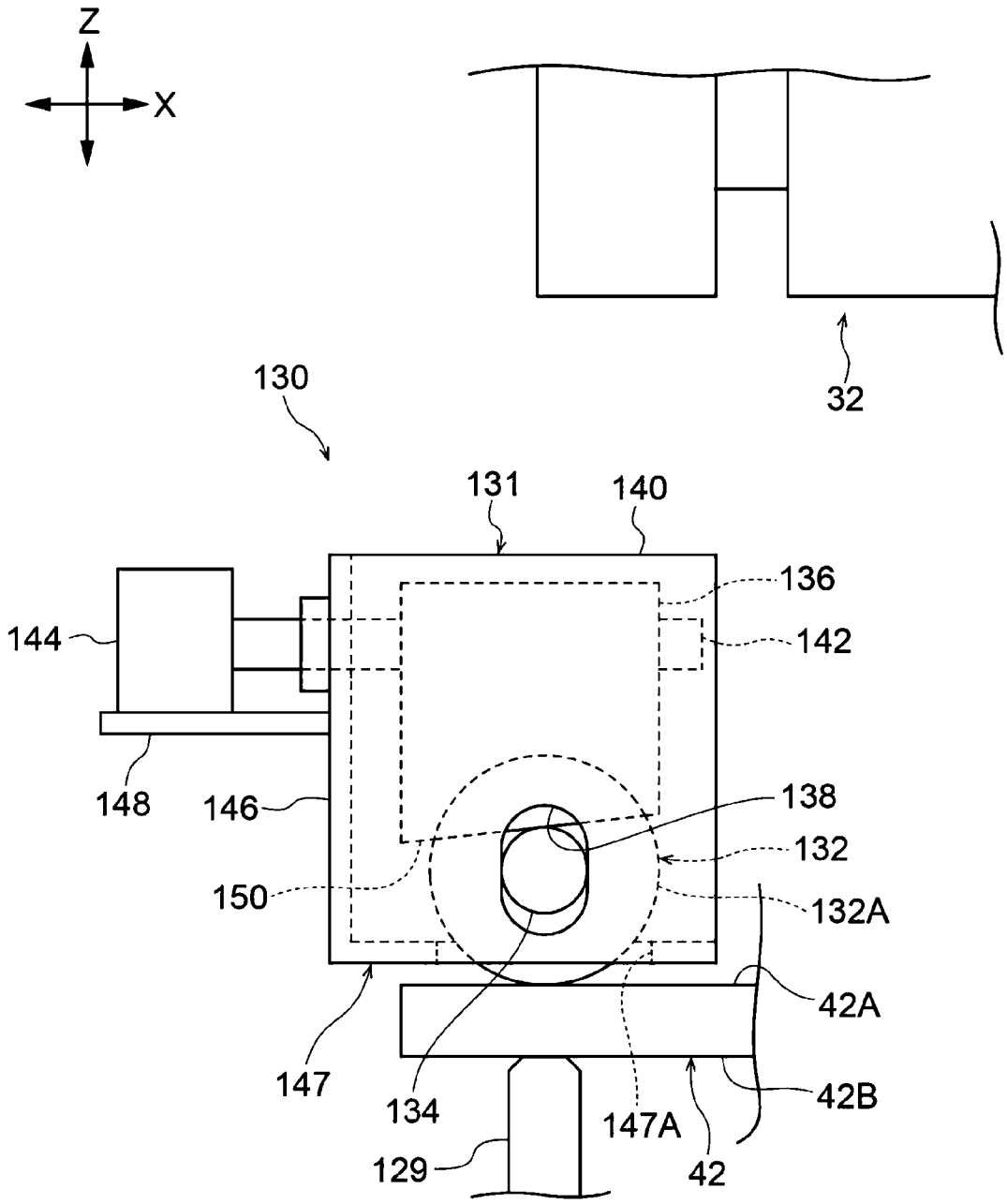
FIG. 10 is a side view of a position adjuster of the exposure device.

The exposure device 40 includes a light emitter 41 and a position adjusters 130 as illustrated in FIG. 10.

Light Emitter 41

As illustrated in FIGS. 2 and 3, the light emitter 41 includes a substrate 42 extending in a first direction (a direction of arrow X in the present exemplary embodiment) and multiple light radiators 44 disposed on one side of the substrate 42 in the direction of arrow Z (upper side in the vertical direction in FIGS. 2 and 3). In the present exemplary embodiment, the light emitter 41 includes three light radiators 44 extending in a first direction of the substrate 42. The substrate 42 is a long rectangular member in a plan view in FIG. 3. The light radiators 44 have the same structure, and are long rectangular members in a plan view in FIG. 3.

For example, the three light radiators 44 are misaligned in a first direction (direction of arrow X) of the substrate 42, and misaligned in the width direction perpendicular to the first direction of the substrate 42, that is, misaligned in the cross direction (direction of arrow Y) of the substrate 42. The light emitter 41 is disposed in the axial direction of the photoconductor drum 32 (refer to FIG. 1). The length of the light emitter 41 in the first direction (direction of arrow X) is longer than the length of the photoconductor drum 32 in the axial direction. At least one of the three light radiators 44 faces the surface (outer peripheral surface) of the photoconductor drum 32. Thus, light emitted from the light emitter 41 is applied to the surface of the photoconductor drum 32.

In FIGS. 2 and 3 and other drawings, the light emitter 41 is illustrated with a side of the substrate 42 where the light radiators 44 are disposed on the upper side in the vertical direction, and light is emitted upward from the light radiators 44. On the other hand, in the image forming apparatus 10 in FIG. 1, the exposure device 40 is illustrated upside down in the vertical direction. Specifically, in FIG. 1, the exposure device 40 is disposed while having a side of the substrate 42 where the light radiators 44 are disposed on the lower side in the vertical direction, and light is emitted downward toward the photoconductor drum 32 from the light radiators 44.

In the present exemplary embodiment, the three light radiators 44 are staggered when viewed from above in the vertical direction of the exposure device 40 (refer to FIG. 3). More specifically, two light radiators 44 are disposed at both end portions of the substrate 42 in the first direction (direction of arrow X) and at a first side of the substrate 42 in the cross direction (direction of arrow Y). One light radiator 44 is disposed at the middle of the substrate 42 in the first direction (direction of arrow X) and at a second side of the substrate 42 in the cross direction (direction of arrow Y). End portions of the two light radiators 44 disposed at the first side of the substrate 42 in the cross direction (direction of arrow Y) and end portions of the light radiator 44 disposed at the second side of the substrate 42 in the cross direction (direction of arrow Y) overlap each other when viewed in the cross direction (direction of arrow Y) of the substrate 42. Specifically, the irradiation areas that are irradiated with light from the three light radiators 44 overlap each other in the first direction (direction of arrow X) of the substrate 42.

Figure 4:
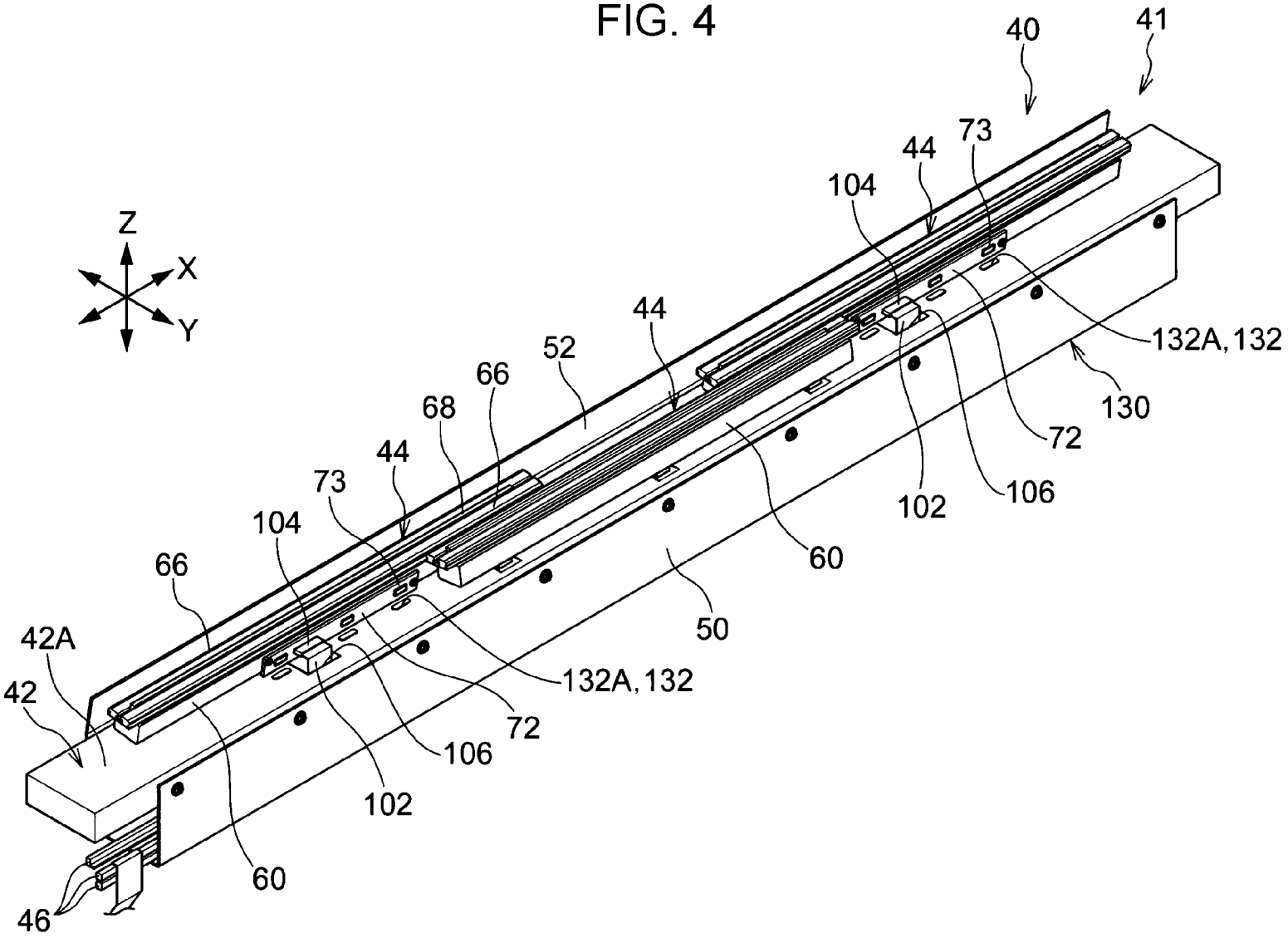
FIG. 4 is a perspective view of multiple light radiators in the exposure device.
Figure 5:
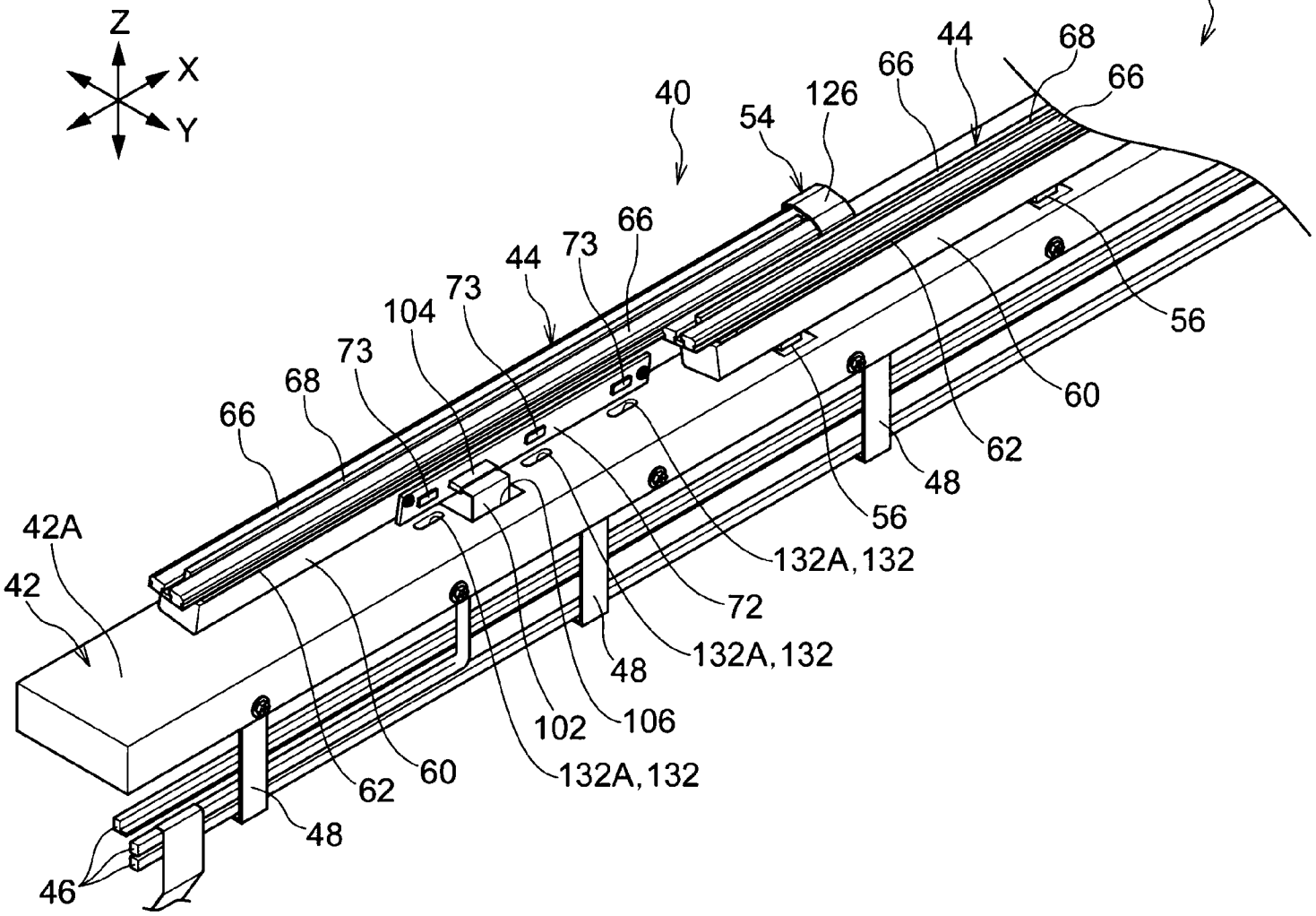
FIG. 5 is a partially enlarged perspective view of the exposure device.

As illustrated in FIGS. 4 and 5, the exposure device 40 includes harnesses 46 electrically connected to the three light radiators 44, multiple brackets 48 that hold the harnesses 46, and a lower covering 50 covering the harnesses 46 and the brackets 48. The harnesses 46 form an assemblage or a bundle of multiple wires used for power supply. The brackets 48 are attached to the substrate 42, and extend from the substrate 42 to the second side (lower side in the vertical direction in FIG. 2) in the direction of arrow Z. The lower covering 50 is attached to the second side (lower side in the vertical direction in FIG. 2) of the substrate 42 in the direction of arrow Z.

As illustrated in FIGS. 2 and 3, the exposure device 40 includes side coverings 52 that cover the sides of the three light radiators 44. The side coverings 52 have a plate shape and lower end portions attached to both sides of the substrate 42 in the cross direction (direction of arrow Y). The exposure device 40 includes cleaning devices 54 that clean lenses 68 of the light radiators 44. The lenses 68 will be described below.

Figure 6:
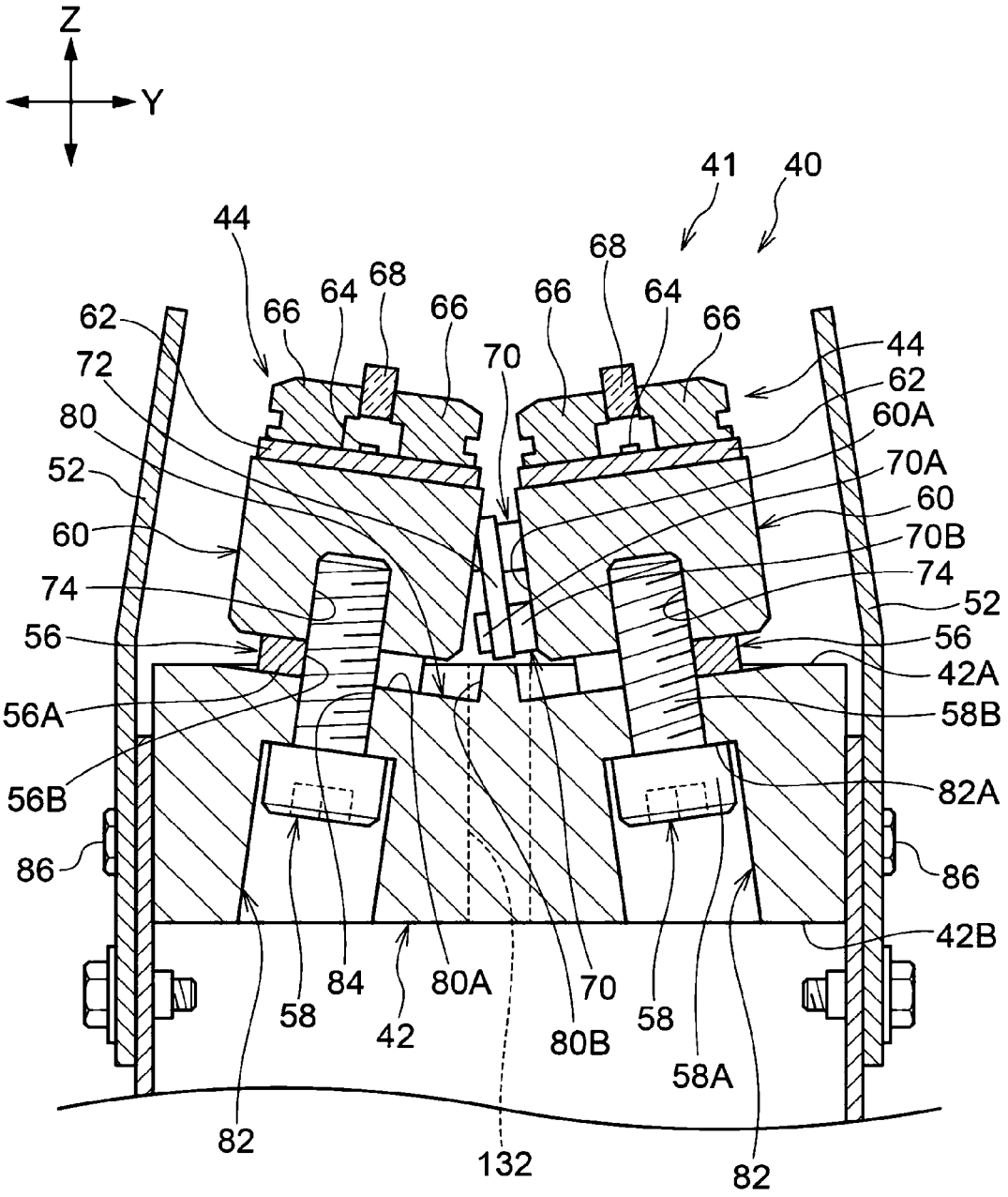
FIG. 6 is a cross-sectional view of the multiple light radiators in the exposure device taken in a cross direction.

As illustrated in FIGS. 5 and 6, the exposure device 40 includes multiple spacers 56 held between the substrate 42 and the light radiators 44, and fastening members 58 that fasten the light radiators 44 to the substrate 42 with the multiple spacers 56 interposed therebetween. The fastening members 58 each have, for example, a helical groove for fastening. In other words, each fastening member 58 is a member with a screw mechanism, such as a screw or a bolt.

Although not illustrated, positioning shafts extending upward in the vertical direction are disposed at both ends of the substrate 42 in the first direction (direction of arrow X). The positioning shafts are received in insertion portions formed in bearings at both ends of the photoconductor drum 32, to fix the position of the light emitter 41 with respect to the photoconductor drum 32 in the direction perpendicular to the light emission direction. More specifically, the position of the light emitter 41 is fixed in the Y direction with respect to the photoconductor drum 32.

As illustrated in FIGS. 5 to 8, the substrate 42 is formed from a thin rectangular-parallelepiped member. The substrate 42 is disposed to face the photoconductor drum 32 (FIG. 1) along the full length in the axial direction.

Recesses 80 that receive the spacers 56 are formed in a surface 42A of the substrate 42 on the upper side in the vertical direction (direction of arrow Z) (refer to FIG. 6). For example, three spacers 56 are disposed at intervals in the first direction (direction of arrow X) for each of the light radiators 44. In the present exemplary embodiment, three spacers 56 are disposed for each of the three light radiators 44.

Each of the recesses 80 includes a slope 80A that forms a bottom surface and is inclined with respect to the surface 42A of the substrate 42, a vertical wall 80B disposed at a downward end of the slope 80A, and two opposing vertical walls (not illustrated) on both sides of the slope 80A (refer to FIG. 5). For example, the slopes 80A facing the two light radiators 44 disposed on the first side of the substrate 42 in the cross direction are inclined in the direction opposite to the direction in which the slope 80A facing the one light radiator 44 disposed on the second side of the substrate 42 in the cross direction is inclined. In the light emitter 41, the slopes 80A inclined opposite to each other adjust light to be applied to the center portion of the photoconductor drum 32

(refer to FIG. 1) using the two light radiators 44 disposed on the first side of the substrate 42 in the cross direction and the one light radiator 44 disposed on the second side of the substrate 42 in the cross direction.

When the light emitter 41 includes only one light radiator 44, the light emission direction of the light emitter 41 toward the photoconductor drum 32 corresponds to the optical axis direction of the light radiator 44. On the other hand, when the light emitter 41 includes multiple light radiators 44 as in the present exemplary embodiment, the direction toward the focal point from the middle point in the cross direction (Y direction) of the substrate 42 between the principal points of the light radiators 44 when viewed in the first direction (X direction) of the substrate 42 is a light emission direction. In the present exemplary embodiment, the positions and the angles of the light emitters 41 are adjusted so that the direction toward the center of the photoconductor drum 32 is aligned with the light emission direction.

In the present exemplary embodiment, the substrate 42 is formed from a metal block. Instead of including typical sheet metal that is shaped by bending, the metal block in the present exemplary embodiment has a shape used as a substrate of the exposure device 40 and a thickness that is not substantially bendable. For example, the substrate 42 is formed from a metal block with a thickness of higher than or equal to 10% of the width of the substrate 42. More specifically, the substrate 42 may be formed from a metal block with a thickness of higher than or equal to 20% and lower than or equal to 100% of the width of the substrate 42.

Unlike a full-color printer for commercial printing, an existing wide-image forming apparatus is used to output monochrome images for which a high image quality is not desired, and thus includes a substrate formed from sheet metal. On the other hand, the image forming apparatus 10 according to the exemplary embodiment is a full-color printer for commercial printing for which a high image quality is desired. Thus, to reduce the effect of deflection of the substrate 42 on the image quality, a metal block that is more rigid than sheet metal is used.

The substrate 42 is formed from, for example, steel or stainless steel. Alternatively, the substrate 42 may be formed from a metal block made of steel or stainless steel. For example, the metal block may be made of aluminum that is lighter in weight and has higher thermal conductivity than steel or stainless steel. In the present exemplary embodiment, heat generated by light sources 64 is mostly radiated by support bodies 60. Thus, the substrate 42 is formed from steel or stainless steel by giving priority in rigidity rather than thermal conductivity or weight.

The thickness of the substrate 42 in the vertical direction (direction of arrow Z) is preferably larger than the thickness of the support bodies 60 forming the light radiators 44. Thus, the rigidity of the substrate 42 (flexural rigidity in the direction of arrow Z) is larger than the rigidity of the light radiators 44. The thickness of the substrate 42 in the vertical direction (direction of arrow Z) is preferably larger than or equal to 5 mm, more preferably larger than or equal to 10 mm, and further more preferably larger than or equal to 20 mm.

As illustrated in FIG. 6, recessed portions 82 set back toward the spacers 56, that is, toward the recesses 80 are formed in an underside 42B of the substrate 42 opposite to the surface 42A. The recessed portions 82 are formed at positions corresponding to the recesses 80 of the substrate 42. The recessed portions 82 are obliquely formed from the underside 42B of the substrate 42 toward the center portion of the substrate 42 in the cross direction (Y direction). For example, the recessed portions 82 are circular when viewed from the underside 42B of the substrate 42. The inner diameter of each recessed portion 82 is larger than the outer diameter of a head 58A of the corresponding fastening member 58. A through-hole 84 in the substrate 42 through which a shank 58B of each fastening member 58 extends is formed in a bottom surface 82A of the corresponding recessed portion 82. The through-hole 84 is open in the slope 80A of each recess 80.

As illustrated in FIGS. 2 to 7, the three light radiators 44 have the same structure, as described above. For example, the two light radiators 44 on the first side of the substrate 42 in the cross direction (direction of arrow Y) and the one light radiator 44 on the second side of the substrate 42 in the cross direction (direction of arrow Y) are disposed to be symmetrical with respect to the cross direction (direction of arrow Y) of the substrate 42.

As illustrated in FIG. 6, each of the light radiators 44 includes a support body 60 extending in the first direction (direction of arrow X), and a light-emitting device substrate 62 supported on a surface of the support body 60 opposite, in the vertical direction (direction of arrow Z), to the surface facing the substrate 42 (supported on the upper surface in the vertical direction in the present exemplary embodiment). The multiple light sources 64 are arranged on the light-emitting device substrate 62 in the first direction. In the present exemplary embodiment, each of the light sources 64 includes multiple light-emitting devices. For example, each light source 64 is a light-emitting device array including a semiconductor substrate and multiple light-emitting devices arranged on the semiconductor substrate in the first direction. In the present exemplary embodiment, the light-emitting device arrays each formed from the light source 64 are disposed on the light-emitting device substrate 62 in a manner staggered in the first direction. Instead of a light-emitting device array, each light source 64 may be a single light-emitting device. Each light-emitting device is formed from, for example, a light-emitting diode, a light emitting thyristor, or a laser element. When arranged in the first direction, the light-emitting devices have, for example, a resolution of 2400 dpi. The light-emitting device substrate 62 is a substrate for allowing at least one of the multiple light sources 64 to emit light. FIG. 6 illustrates only one light source 64 disposed on each of the light radiators 44, and omits illustration of other light sources.

Each of the light radiators 44 includes a pair of attachments 66 disposed on the surface of the light-emitting device substrate 62 opposite to the surface on which the support body 60 is disposed, and a lens 68 held between upper end portions of the pair of attachments 66.

The pair of attachments 66 and the lens 68 extend in the first direction (direction of arrow X) of the support body 60 (refer to, for example, FIG. 4). The lens 68 is disposed to oppose the multiple light sources 64 while leaving a space between the lens 68 and the multiple light sources 64. In the exposure device 40, light emitted from the multiple light sources 64 passes through the lens 68, and is applied to the surface of the photoconductor drum 32 (refer to FIG. 1) serving as an irradiated object.

Each support body 60 is formed from a rectangular parallelepiped member. In the present exemplary embodiment, as in the substrate 42, the support body 60 is formed from a metal block. For example, the support body 60 is formed from steel or stainless steel. Alternatively, the substrate 42 may be formed from a metal block made of a material other than steel or stainless steel. For example, the metal block may be made of aluminum that is lighter in weight and has higher thermal conductivity than steel or stainless steel. However, when the substrate 42 and the support body 60 have different coefficients of thermal expansion, distortion or deflection may occur. Thus, in view of reducing distortion or deflection, the substrate 42 and the support body 60 are preferably formed from the same material.

A threaded hole 74 into which the shank 58B of each fastening member 58 is fastened is formed in the surface of the support body 60 facing the substrate 42 (refer to FIG. 6). The threaded hole 74 is formed at a position opposing the corresponding through-hole 84 in the substrate 42.

While the fastening members 58 are received in the recessed portions 82 in the substrate 42 and the shanks 58B of the fastening members 58 extend through the through-holes 84 in the substrate 42, the shanks 58B of the fastening members 58 are fastened to the threaded holes 74 of the support body 60 with the spacers 56 interposed therebetween. Thus, the light radiators 44 are fastened to the substrate 42 with the fastening members 58 in the recessed portions 82 of the substrate 42. While the light radiators 44 are fastened to the substrate 42 with the fastening members 58, the spacers 56 are interposed between the substrate 42 and the support bodies 60.

A method for fastening, with the fastening members 58, the light radiators 44 from the surfaces (light emitting surfaces) of the support bodies 60 to the surface of the substrate 42 is conceivable. However, unlike a support body made of a resin material or formed from sheet metal, each support body 60 according to the present exemplary embodiment is formed from a metal block with a heavy mass. Thus, the fastening members 58 are correspondingly to have a large size and mass. This structure involves leaving a space for the large-sized fastening members 58 over the surface of the support body 60, and size increase of the support body 60. To avoid this, in the present exemplary embodiment, each support body 60 is fastened from the underside.

In a structure including the fastening members 58 at not only both ends of the support body 60 but also at the center portion, the existence of the light source 64 at the center portion prevents fastening of the support body 60 from the surface side. Thus, the structure where both ends and the center portion of the support body 60 are fastened only involves fastening from the underside of the substrate 42.

When viewed in the optical axis direction of the light sources 64, the threaded holes 74 and the recessed portions 82 of the substrate 42 are located to overlap the light sources 64. Compared to the structure where the threaded holes 74 and the recessed portions 82 are located not to overlap the light sources 64, this structure facilitates dissipation of heat generated from the light sources 64 to the substrate 42 through the fastening members 58.

As illustrated in FIGS. 6, 7, 8, and 9, a driving substrate 72 is attached to the support body 60 of each light radiator 44 with fittings 70. The driving substrate 72 is an example of a substrate. The driving substrate 72 extends in the first direction (direction of arrow X). The length of each driving substrate 72 in the first direction is shorter than the length of the corresponding support body 60 in the first direction (refer to FIG. 8). Each driving substrate 72 is a substrate that drives the corresponding light radiator 44, and formed from, for example, an application specific integrated circuit (ASIC) substrate.

Figure 9:
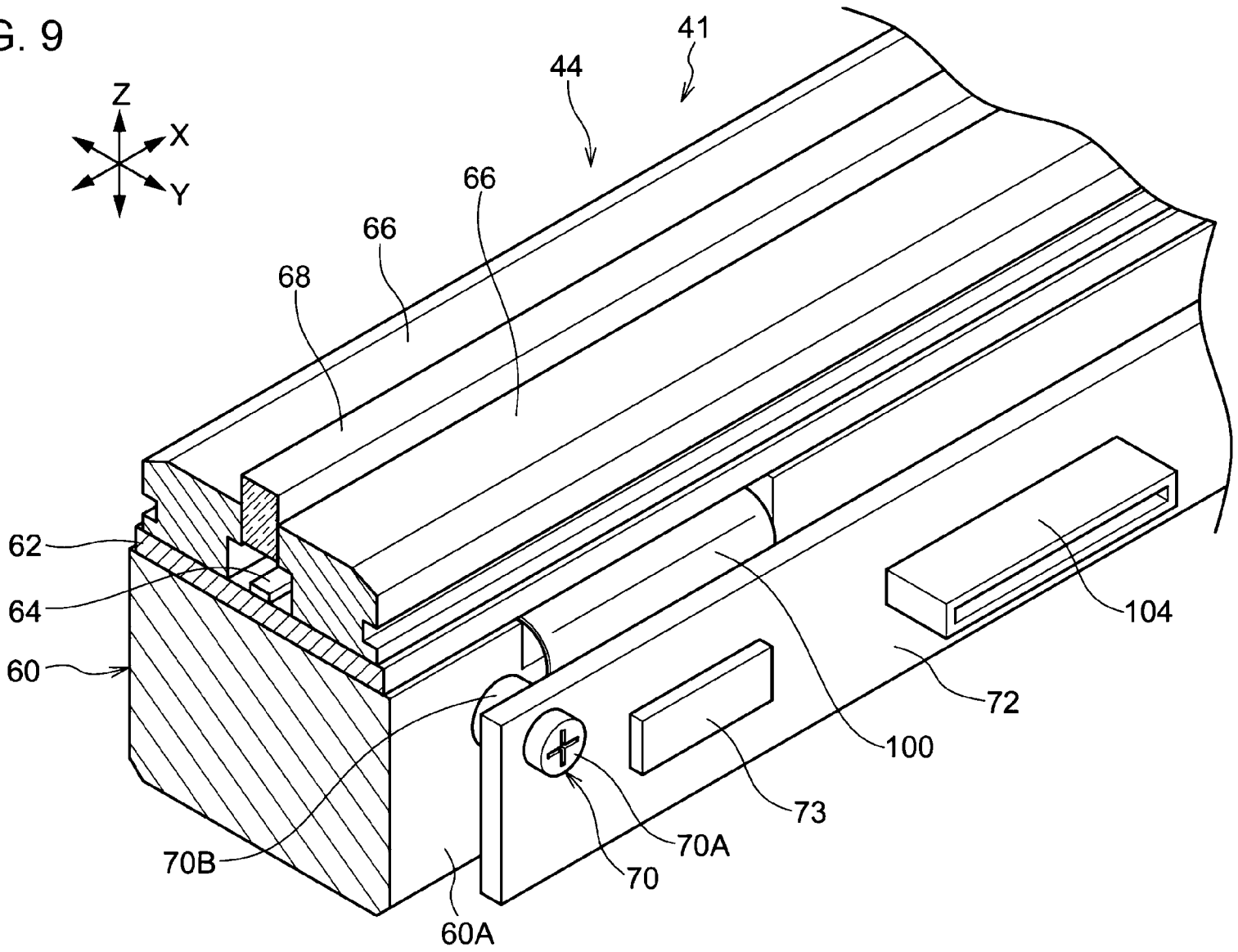
FIG. 9 is a perspective view of part of the light radiators taken in the cross direction.

Each fitting 70 includes a fastening bolt 70A and a tube 70B disposed between the support body 60 and the driving substrate 72 (refer to FIG. 9). For example, the tube 70B is made of metal, and joined to the driving substrate 72 by, for example, soldering. Although not illustrated, the driving substrate 72 has openings continuous with the through-holes of the tubes 70B. The shank of each fastening bolt 70A extends through the tube 70B. The shank of the fastening bolt 70A extends through the tube 70B from the side closer to the driving substrate 72, and is fastened to the support body 60 to attach the driving substrate 72 to the support body 60. The driving substrate 72 is attached to the support body 60 with two fittings 70 disposed at both ends of the driving substrate 72 in the first direction.

Figure 7:
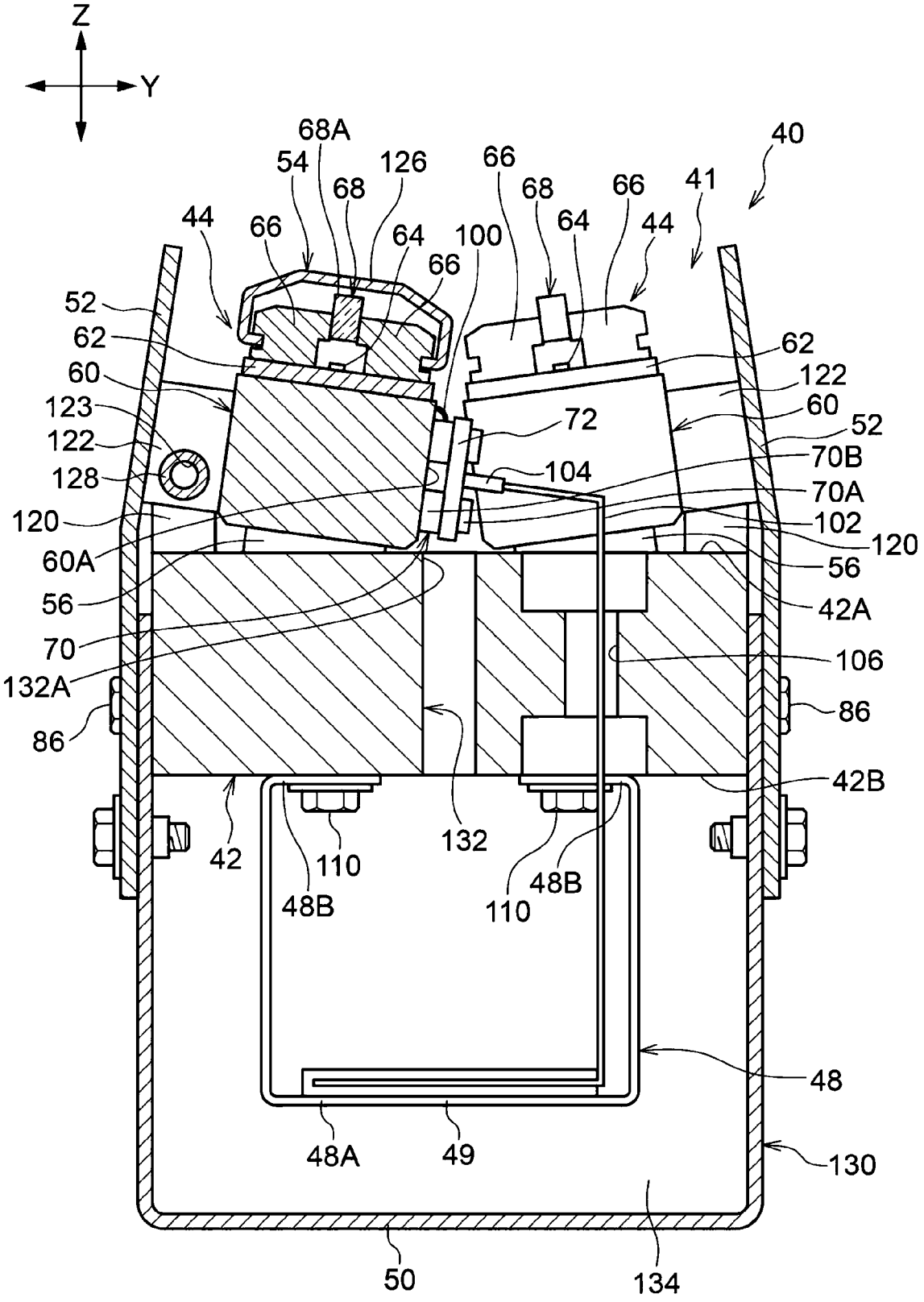
FIG. 7 is a cross-sectional view of the exposure device taken in the cross direction.

The surface of the driving substrate 72 (that is, flat surface) extends along an inner side portion 60A of the support body 60 in the cross direction (direction of arrow Y) of the substrate 42 (refer to FIG. 7). The inner side portion 60A of the support body 60 refers to the side of the substrate 42 closer to the center portion in the cross direction.

The tube 70B of each fitting 70 forms a gap between the inner side portion 60A of the support body 60 and the surface (flat surface) of the driving substrate 72. Specifically, the driving substrate 72 is attached to the inner side portion 60A of the support body 60 of the corresponding light radiator 44 with the fittings 70 without in direct contact with the inner side portion 60A.

The inner side portion 60A of the support body 60 is a slope inclined inward with respect to the surface 42A of the substrate 42. As in the case of the inner side portion 60A, the flat surface of the driving substrate 72 is also inclined inward with respect to the surface 42A of the substrate 42.

The driving substrate 72 is disposed on each of the three light radiators 44 at the inner side portion 60A of the support body 60.

As illustrated in FIGS. 3 and 4, in a side view, the driving substrate 72 disposed on one light radiator 44 is located not to overlap another light radiator 44 adjacent to the light radiator 44. The driving substrates 72 of the three light radiators 44 disposed on the substrate 42 have the same length in the first direction (direction of arrow X), and are shorter than a portion of the light radiator 44 disposed at the center portion in the first direction that does not overlap the light radiators 44 on both sides in the first direction.

Figure 8:
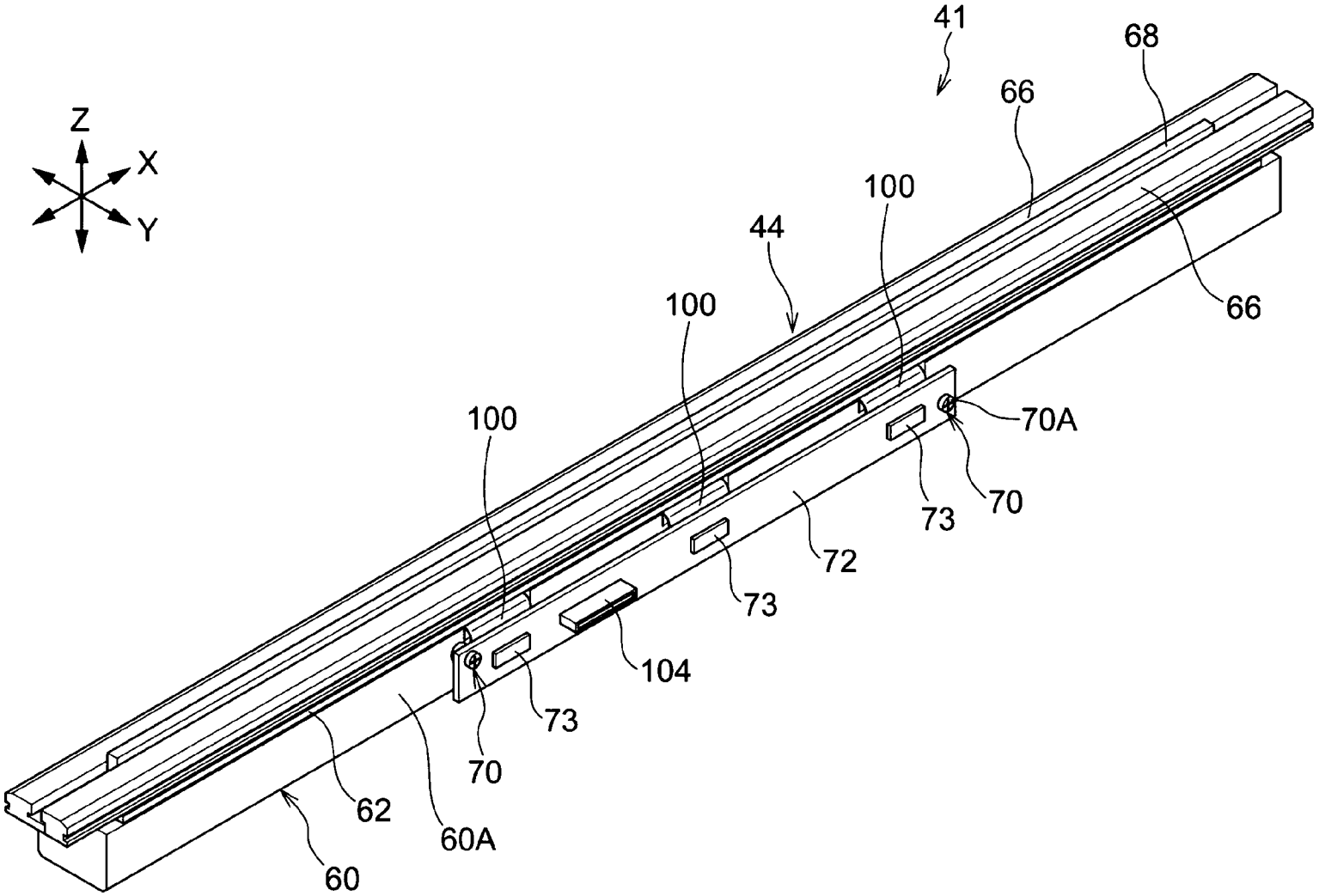
FIG. 8 is a perspective view of light radiators in the exposure device.

As illustrated in FIGS. 7, 8, and 9, three flexible cables 100 are connected to the light-emitting device substrate 62 disposed on the support body 60. The three flexible cables 100 extend to the outer side of the support body 60 from the upper portion of the inner side portion 60A of the support body 60. The three flexible cables 100 extending to the outer side of the support body 60 are electrically connected to three driving elements 73 disposed on the driving substrate 72. Examples usable as the driving elements 73 include integrated circuits.

At a portion of each driving substrate 72 other than both ends in the first direction (direction of arrow X), a connector 104 to which a flat cable 102 from the outer side of the corresponding light radiator 44 is electrically connected is disposed. A connection port of the connector 104 extends in a direction crossing the surface (flat surface) of the driving substrate 72. A connection portion of the flat cable 102 is insertable into and removable from the connector 104 in the direction crossing the surface (flat surface) of the driving substrate 72. The flat cable 102 is an example of a wire.

As illustrated in FIG. 7, the flat cable 102 connected to the connector 104 extends from the driving substrate 72 in a direction away from the support body 60. The substrate 42 has through portions 106 that extend through in the vertical direction (direction of arrow Z) at positions corresponding to the positions of the driving substrate 72 where the flat cables 102 are connected. The through portions 106 are formed in the substrate 42 on the side of the driving substrate 72 in the cross direction (direction of arrow Y) of the substrate 42 and at positions on the side of the driving substrate 72 opposite to the side where the light radiators 44 are disposed (that is, positions where the light radiators 44 are not disposed). The flat cables 102 are inserted into the through portions 106 of the substrate 42 to be routed to the inner side of the lower covering 50 facing the underside 42B of the substrate 42. In other words, the flat cables 102 are disposed in the inner side of the lower covering 50.

As illustrated in FIGS. 4 and 5, each flat cable 102 is connected with the connector 104 interposed therebetween to the driving substrate 72 disposed on each of the three light radiators 44. The substrate 42 has the through portions 106 on the side of the driving substrates 72 attached to the three light radiators 44. The flat cable 102 for each of the three light radiators 44 is received in the corresponding through portion 106 in the substrate 42, and extends to the inner side of the lower covering 50 facing the underside 42B of the substrate 42 (refer to FIG. 7).

For example, the light radiators 44 have a dimension in the height direction longer than the dimension in the width direction that is perpendicular to the first direction (perpendicular to the direction of arrow X). Specifically, the light radiators 44 have a dimension in the vertical direction (direction of arrow Z) longer than the dimension in the cross direction (direction of arrow Y). Thus, the center of gravity of the light radiators 44 is higher than when the light emitter has a dimension in the height direction shorter than the dimension in the width direction perpendicular to the first direction.

As illustrated in FIG. 6, the spacers 56 are held between the substrate 42 and the light radiators 44 in the optical axis direction of the light sources 64. For example, each spacer 56 has a plate shape, and is made of a single member. In the present exemplary embodiment, each spacer 56 has a U shape when viewed in the optical axis direction of the light sources 64. Each spacer 56 includes a body 56A and a hole 56B in one side of the body 56A.

Each spacer 56 is disposed on the slope 80A of the corresponding recess 80 in the substrate 42. Each spacer 56 has a thickness larger than or equal to the depth of the recess 80 at the position where the spacer 56 is disposed on the slope 80A. The fastening members 58 fasten the light radiators 44 to the substrate 42 while imposing a compression load on the spacers 56.

As illustrated in FIG. 7, the brackets 48 have a function of holding the flat cables 102. The brackets 48 are examples of a holding member. More specifically, each bracket 48 includes a U-shaped support portion 48A, protruding from the underside 42B of the substrate 42 in a direction away from the light radiators 44, and a pair of attachment portions 48B bent inward (that is, toward the inner side of the substrate 42 in the cross direction) from the upper end portion of the support portion 48A. The support portion 48A has a flat-surface portion 49 facing the underside 42B of the substrate 42 at the middle of the lower portion of the U shape. The support portion 48A has a portion opposite to the flat-surface portion 49 open toward the substrate 42. The pair of attachment portions 48B are attached to the substrate 42 with fastening members 110 while being in surface contact with the underside 42B of the substrate 42.

The brackets 48 are spaced apart from each other in the first direction (direction of arrow X) of the substrate 42 (refer to FIG. 5). Each flat cable 102 is held at the flat-surface portion 49 of the support portion 48A. The flat cables 102 are supported by the multiple brackets to be arranged in the first direction (direction of arrow X) of the substrate 42 in the inner side of the lower covering 50.

As illustrated in FIGS. 4 and 7, the lower covering 50 covers the harnesses 46 and the flat cables 102 electrically connected to the three light radiators 44. The lower covering 50 is attached to the lower side of the substrate 42 in the vertical direction (that is, on the underside 42B of the substrate 42 illustrated in FIG. 5). The lower covering 50 protrudes from the substrate 42 in a direction away from the light radiators 44, and covers part of the underside 42B of the substrate 42. In the present exemplary embodiment, the lower covering 50 has a U-shaped cross section. The upper end portions of the lower covering 50 are attached to both sides of the substrate 42 in the cross direction (direction of arrow Y) with multiple fastening members 86. The lower covering 50 is attachable to and removable from the substrate 42 by fastening or removing the multiple fastening members 86.

The lower covering 50 raises the substrate 42 when having the bottom placed on a horizontal plane. When the substrate 42 formed from a metal block is raised, the center of gravity of the exposure device 40 is raised.

As illustrated in FIGS. 2, 6, and 7, the side coverings 52 are disposed on both edges of the substrate 42 in the cross direction (direction of arrow Y). The side coverings 52 extend in the first direction (direction of arrow X) on the sides of the three light radiators 44. Thus, the side coverings 52 have a function of protecting the three light radiators 44 from the outside.

In a side view of the exposure device 40 (when viewed in the direction of arrow Y), the side coverings 52 are disposed to overlap the three light radiators 44. The side coverings 52 are longer in the first direction (direction of arrow X) than the longitudinal area of the substrate 42 where the three light radiators 44 are disposed (refer to FIGS. 2 and 3).

As illustrated in FIG. 7, a support portion 122 that supports the corresponding side covering 52 is disposed on the inner side of the side covering 52. An attachment 120 is disposed on the surface 42A of the substrate 42 at the end in the cross direction (direction of arrow Y) to support the support portion 122. The support portion 122 is in contact with the corresponding side covering 52 to support the side covering 52 so that the side covering 52 does not fall toward the light radiators 44. The support portions 122 are disposed on the side coverings 52 on both sides of the substrate 42 in the cross direction. Although not illustrated, the support portions 122 are disposed at intervals in the first direction (direction of arrow X) of the side coverings 52.

Position Adjuster 130

Figure 11:
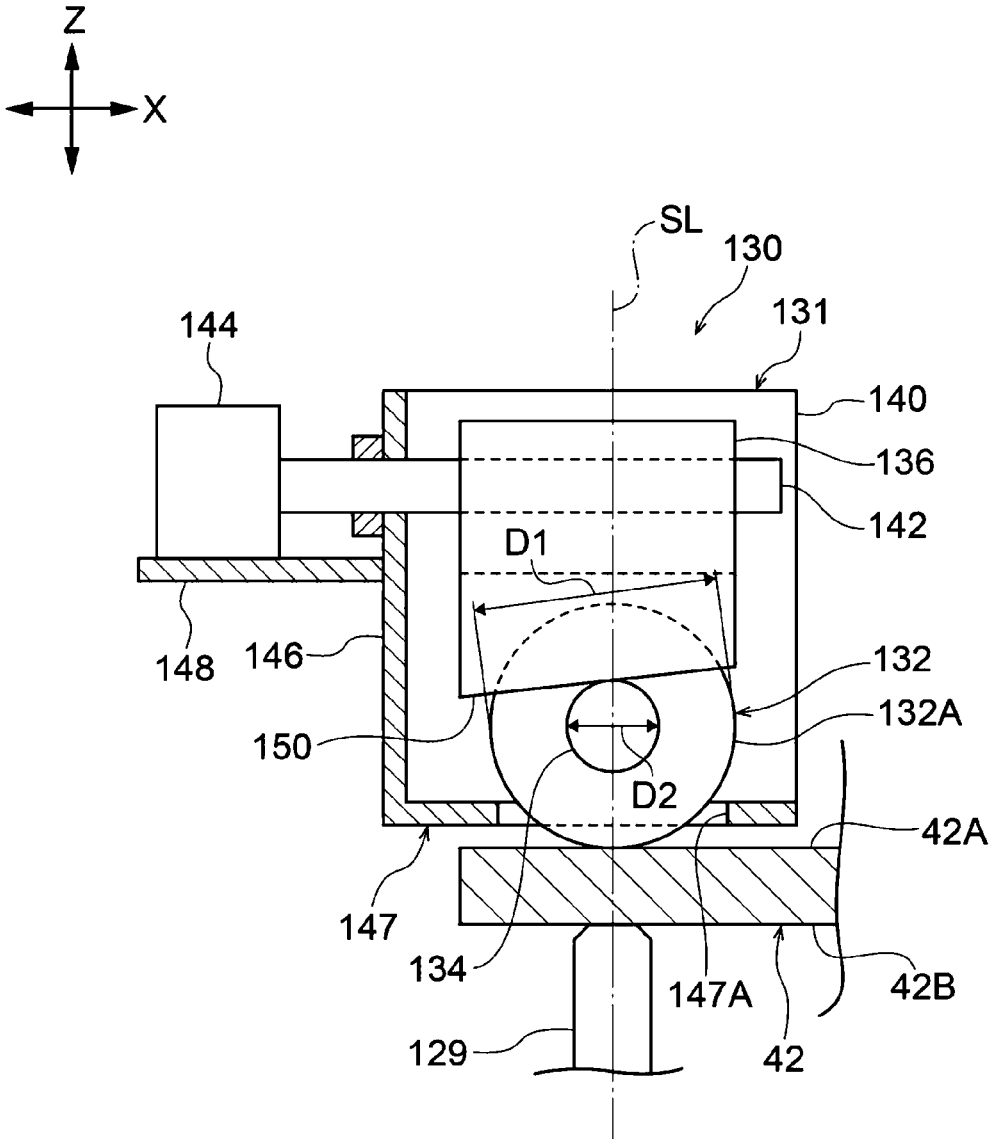
FIG. 11 is a cross-sectional side view of part of the position adjuster of the exposure device.
Figure 12:
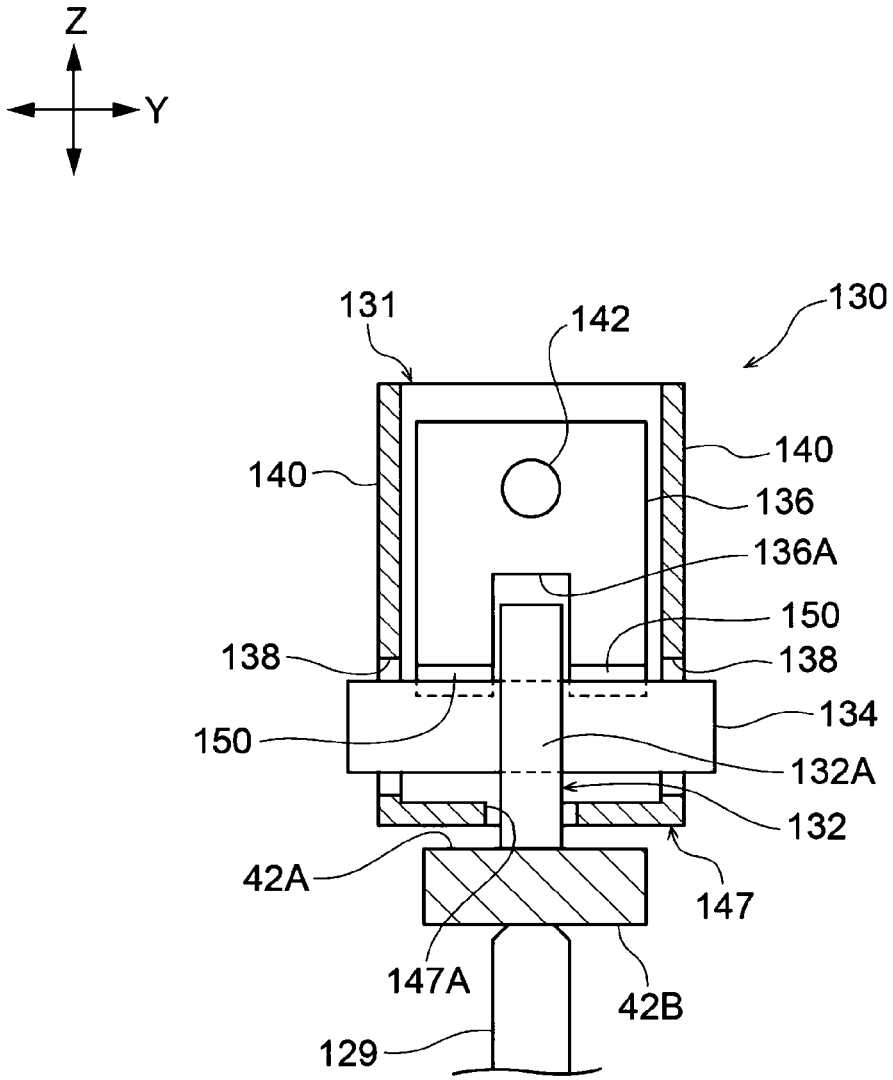
FIG. 12 is a cross-sectional front view of part of the position adjuster of the exposure device.

As illustrated in FIGS. 10 to 12, the position adjuster 130 is a mechanism for adjusting the distance between the light emitter 41 and the photoconductor drum 32. More specifically, the position adjuster 130 adjusts the position of the light emitter 41 with respect to the photoconductor drum 32. More specifically, the position adjuster 130 moves the light emitter 41 in the light emission direction to adjust the position of the light emitter 41 with respect to the photoconductor drum 32. In the present exemplary embodiment, the light emission direction of the light emitter 41 is substantially the same as the Z direction.

As illustrated in FIG. 10, the position adjuster 130 includes a contact member 132, a support member 134, and a mover 136.

Contact Member 132

As illustrated in FIG. 10, the contact member 132 is a member having an outer peripheral surface 132A in contact with the surface 42A of the substrate 42. The contact member 132 has a disk shape, and is rotatably supported by the support member 134. More specifically, the contact member 132 is supported by the support member 134 to rotate relative to the support member 134. For example, the contact member 132 according to the present exemplary embodiment is a ball bearing.

Support Member 134

The support member 134 is a member that rotatably supports the contact member 132. The support member 134 supports the contact member 132 while allowing the contact member 132 to rotate relative to the support member 134. As illustrated in FIGS. 10 and 12, the support member 134 is a substantially cylindrical shaft, and has both ends in the axial direction received by a pair of receiving portions 138. More specifically, the pair of receiving portions 138 are disposed to oppose each other in the X direction or the cross direction of the substrate 42. The pair of receiving portions 138 allow the support member 134 to rotate about the axis or the X direction, and to move in the light emission direction. In other words, the contact member 132 is disposed between the pair of receiving portions 138 of the support member 134.

As illustrated in FIG. 12, the pair of receiving portions 138 are long wall holes formed in a pair of support plates 140 opposing each other in the X direction with the contact member 132 in between. These long holes have a length in the Z direction. Thus, the receiving portions 138 are capable of supporting the support member 134 while allowing both ends of the support member 134 in the axial direction to rotate and to move in the light emission direction. Safety lock stoppers (not illustrated) are attached to both ends of the support member 134 in the axial direction.

As illustrated in FIG. 11, an outer diameter D1 of the contact member 132 is larger than an outer diameter D2 of the support member 134.

As illustrated in FIG. 11, the mover 136 is a member that is in contact with the support member 134 to move the support member 134 in the light emission direction of the light emitter 41.

The mover 136 is movable in the X direction. More specifically, the position adjuster 130 includes a feeder 142 and a driving source 144, and the feeder 142 moves the mover 136 in the X direction. In the present exemplary embodiment, the feeder 142 is a feed screw serving as an example of a screw member. The feeder 142 extends through a coupling plate 146 that couples ends of the pair of support plates 140 in the X direction. The driving source 144 is coupled to one end of the feeder 142 in the axial direction. The driving source 144 drives the feeder 142 to rotate. The driving source 144 according to the present exemplary embodiment is, for example, an electric motor, but the present disclosure is not limited to this structure. The driving source 144 is attached to an attachment plate 148 protruding from the coupling plate 146 to the first side (to the left in FIG. 11, or to the near side in the apparatus depth direction) in the X direction. In the present exemplary embodiment, the pair of support plates 140, the coupling plate 146, and the attachment plate 148 constitute a housing 131 of the position adjuster 130. This housing 131 is attached to a frame, not illustrated, included in the image forming unit 14.

The mover 136 includes converters 150 that convert the moving force in the X direction provided by the feeder 142 into the moving force of the support member 134 to move in the light emission direction. More specifically, the converters 150 are slopes disposed at portions of the mover 136 that are in contact with the support member 134 and that are inclined with respect to the X direction. More specifically, as illustrated in FIG. 12, the mover 136 includes a pair of converters 150 (a pair of slopes), and the pair of converters 150 are in contact with both portions of the support member 134 in the axial direction with the contact member 132 in between. For example, the mover 136 according to the present exemplary embodiment is rectangular parallelepiped, and has a groove 136A at a portion corresponding to the contact member 132. The groove 136A receives part of the outer periphery of the contact member 132, and extends in the X direction. The pair of converters 150 are disposed on both sides of the support member 134 with the groove 136A in between.

As illustrated in FIG. 10, the substrate 42 is pressed toward the position adjuster 130 by a presser 129 disposed on the side opposite to the side where the position adjuster 130 is disposed. More specifically, the substrate 42 is held with pressure between the position adjuster 130 and the presser 129 in the Z direction. When the mover 136 moves in the X direction, the slopes serving as the converters 150 provide the moving force in the Z direction to the support member 134 via the outer peripheral surface of the support member 134. When the moving force in the Z direction is provided to the support member 134, the moving force is transmitted from the support member 134 to the substrate 42 via the contact member 132 to push back the presser 129. Thus, the substrate 42 moves in the Z direction, that is, the position of the substrate 42 is adjusted.

As illustrated in FIG. 12, the contact member 132 and the feeder 142 that extend through the mover 136 overlap in the light emission direction. As illustrated in FIG. 11, in the present exemplary embodiment, for example, a straight line SL that passes a contact point between the contact member 132 and the substrate 42 and a contact point between the mover 136 and the support member 134 extends in the light emission direction of the light emitter 41.

The coefficient of friction between the contact member 132 and the substrate 42 is smaller than the coefficient of friction between the support member 134 and the contact member 132. More specifically, in the present exemplary embodiment, the contact member 132 is a ball bearing. Thus, the contact member 132 rotates relative to the support member 134 before friction occurs between the contact member 132 and the substrate 42.

The ends of the pair of support plates 140 in the Z direction are coupled together with a coupling plate 147. The coupling plate 147 has an opening 147A. Part of the outer periphery of the contact member 132 protrudes through the opening 147A. The protruding part of the contact member 132 is in contact with the surface 42A of the substrate 42.

In the image forming apparatus 10 according to the present exemplary embodiment, the distance from the light emitter 41 to the surface of the photoconductor drum 32 is measured by measuring devices not illustrated disposed at both ends of the substrate 42, and the measurement information is transmitted to a controller not illustrated. The controller operates the position adjusters 130 based on the measurement information. More specifically, the controller adjusts the driving amount of the driving source 144 based on the measurement information. When the values measured by the measuring devices fall within a predetermined set range, the controller stops the operation of the driving source 144. The position adjustment on the light emitter 41 may be performed by the position adjuster 130 at a timing when the light emitter 41 is attached to the photoconductor drum 32 or at a timing a predetermined time length (period) after the attachment.

Subsequently, the operations and effects of the present exemplary embodiment will be described.

In the exposure device 40 according to the present exemplary embodiment, the contact member 132 is supported by the support member 134 to be rotatable relative to the support member 134. Thus, compared to a structure where the contact member 132 is fixed to the support member 134, the exposure device 40 according to the present exemplary embodiment reduces misregistration of the light emitter 41 in the direction perpendicular to the light emission direction.

In the exposure device 40, the coefficient of friction between the contact member 132 and the substrate 42 is smaller than the coefficient of friction between the support member 134 and the contact member 132. Thus, regardless of when movement of the mover 136 imposes a force in the Z direction on the support member 134, the contact member 132 rotates relative to the support member 134, and prevents an excessively large frictional force from occurring between the contact member 132 and the substrate 42. Thus, compared to a structure where the coefficient of friction between the contact member 132 and the substrate 42 is larger than or equal to the coefficient of friction between the support member 134 and the contact member 132, the exposure device 40 prevents misregistration of the light emitter 41 in the direction perpendicular to the light emission direction.

Compared to the structure where the support member 134 extends in the first direction, the exposure device 40 has a shorter length in the first direction.

Compared to the structure where the support member 134 is moved in the light emission direction by the mover 136 moving in the light emission direction, the exposure device 40 has a smaller size in the apparatus light emission direction.

In the exposure device 40, the coefficient of friction between the contact member 132 and the substrate 42 is smaller than the coefficient of friction between the support member 134 and the contact member 132. This structure enables reduction of friction between the mover 136 and the support member 134.

Compared to the structure where the converter 150 formed from a slope of the mover 136 is disposed only on one of both sides of the support member 134 with the contact member 132 in between, the exposure device 40 enables reduction of inclination of the support member 134.

Compared to the structure where the contact member 132 is disposed on the outer side of the opposing receiving portions 138 of the support member 134, the exposure device 40 reduces distortion of the substrate 42 resulting from position adjustment in the light emission direction performed by the contact member 132 on the substrate 42.

Compared to the structure where the outer diameter D1 of the contact member 132 is smaller than or equal to the outer diameter D2 of the support member 134, the exposure device 40 prevents the support member 134 from interfering with the substrate 42 regardless of when the substrate 42 is widened in the cross direction.

Compared to the structure where the feeder 142 and the contact member 132 are misaligned in the light emission direction, the exposure device 40 reduces a loss of the moving force of the mover 136 transmitted to the support member 134.

Compared to the structure where the mover 136 is moved in the first direction by driving a belt to which the mover 136 is attached to rotate, the exposure device 40 enables fine adjustment of the amount of movement of the mover 136 in the first direction.

Compared to the structure where the straight line SL that passes the contact point between the contact member 132 and the substrate 42 and the contact point between the mover 136 and the support member 134 is inclined with respect to the light emission direction, the exposure device 40 reduces misregistration of the light emitter 41 in the direction perpendicular to the light emission direction.

The image forming apparatus 10 including the above exposure device 40 is capable of forming accurate images.

Figure 13:
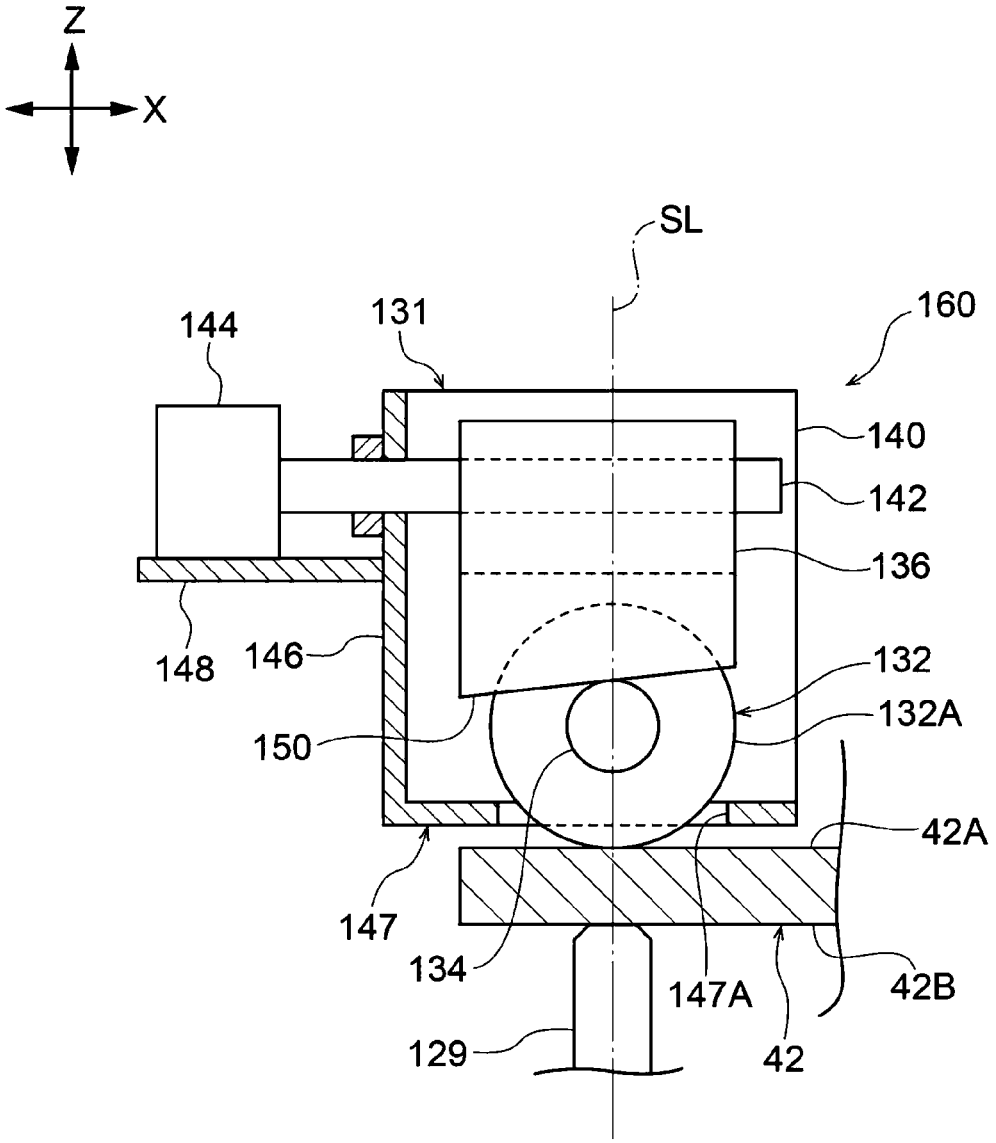
FIG. 13 is a cross-sectional side view of part of a position adjuster according to a modification example.
Figure 14:
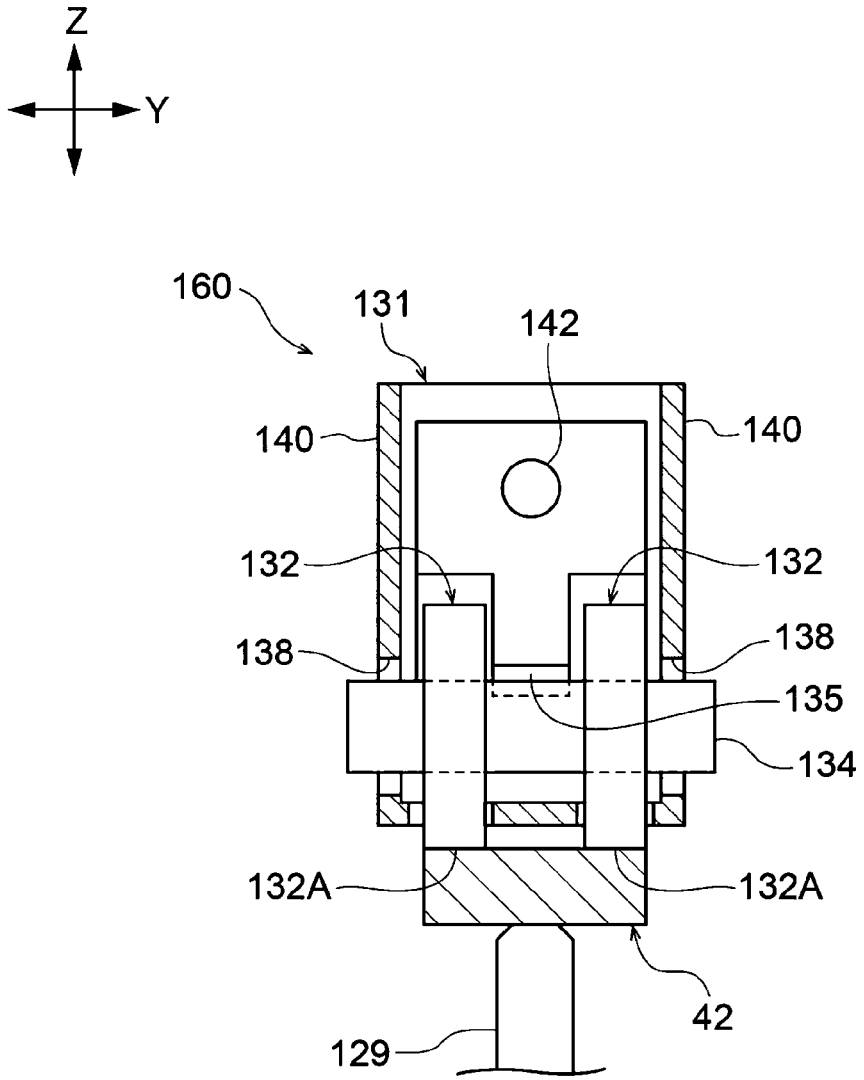
FIG. 14 is a cross-sectional front view of part of the position adjuster according to the modification example.

The position adjuster 130 according to any of the exemplary embodiments includes the contact member 132 disposed between the pair of converters 150 of the mover 136, but the present disclosure is not limited to this structure. For example, as in a position adjuster 160 illustrated in FIGS. 13 and 14, two contact members 132 may be disposed on the support member 134 while being spaced apart from each other in the axial direction. This structure also obtains the operational effects the same as those of the position adjuster 130.

Figure 15:
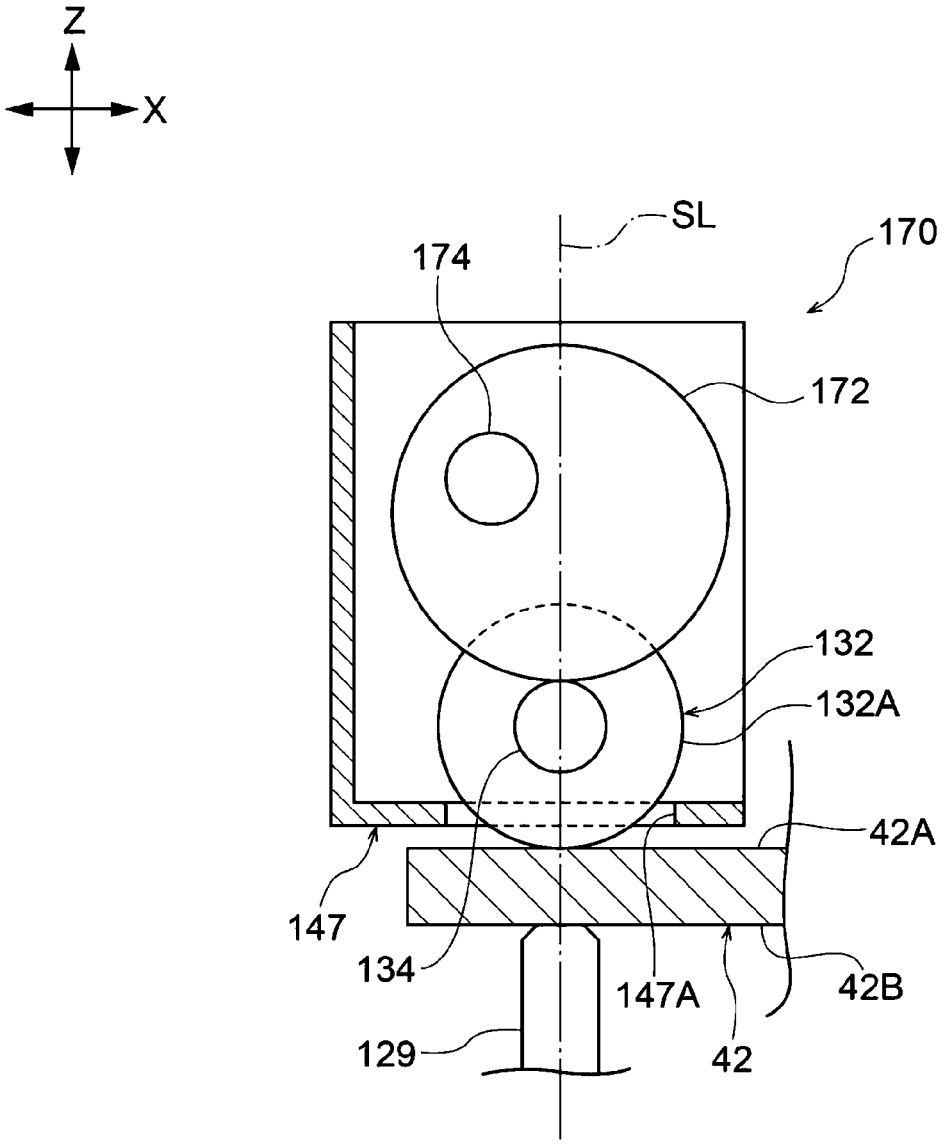
FIG. 15 is a cross-sectional side view of part of a position adjuster according to a modification example.
Figure 16:
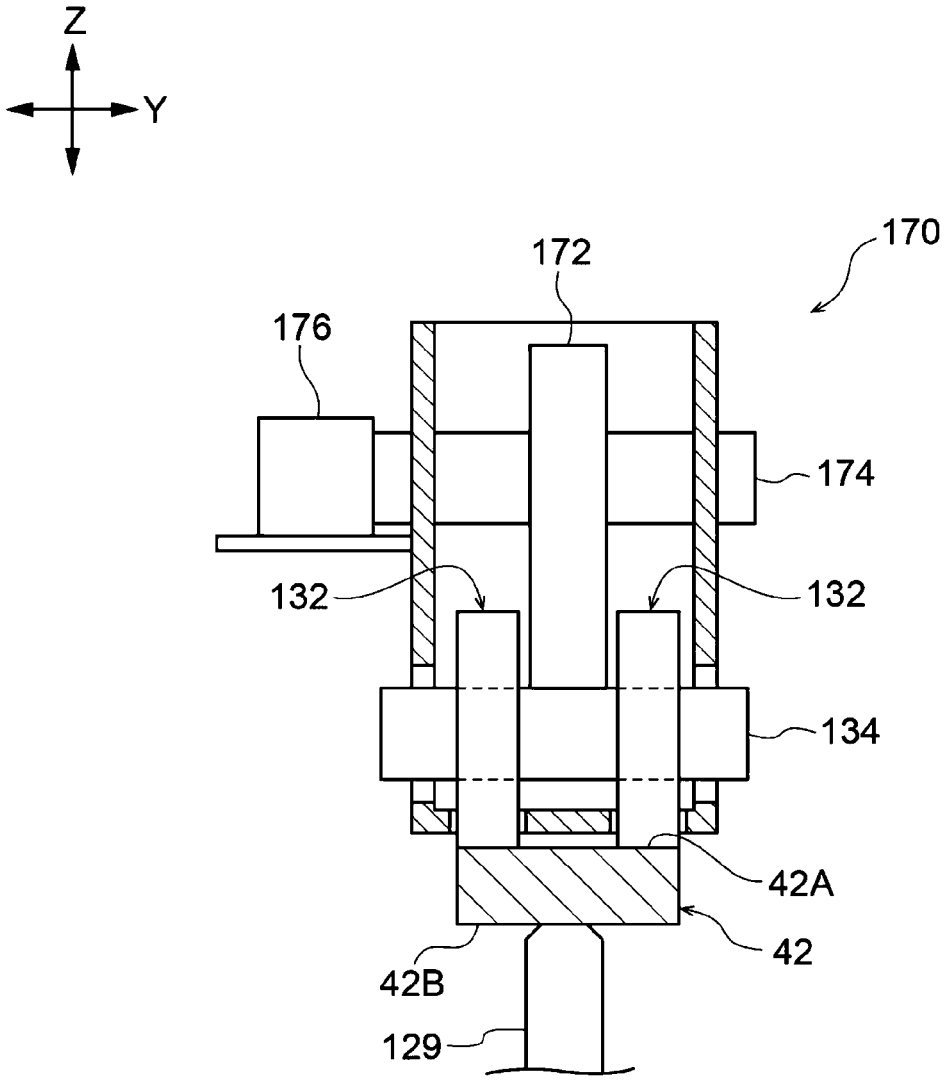
FIG. 16 is a cross-sectional front view of part of the position adjuster according to the modification example.

The position adjuster 130 according to any of the exemplary embodiments moves the support member 134 in the light emission direction by moving the mover 136 in the X direction, but the present disclosure is not limited to this structure. For example, as in a position adjuster 170 illustrated in FIGS. 15 and 16, the support member 134 may be moved in the light emission direction with a mover 172 formed from an eccentric cam. More specifically, a rotation shaft 174 of the mover 172 is rotatably supported by the pair of support plates 140. The rotation shaft 174 is designed to receive a driving force from a driving source 176. The driving source 176 is attached to an attachment plate 178 protruding from one support plate 140. The driving source 176 may be any member capable of driving the rotation shaft 174 to rotate. For example, the driving source 176 may be an electric motor. The driving source 176 and the rotation shaft 174 may be connected together with a belt or a gear. In the position adjuster 170, when the mover 172 rotates about the rotation shaft 174, the moving force in the Z direction is imposed on the support member 134 that is in contact with the mover 172. Specifically, the mover 172 is pushed and the position of the substrate 42 in the Z direction is adjusted. Also in this case, the operational effects the same as those of the position adjuster 130 are obtained.

In the position adjuster 130 according to any of the exemplary embodiments, the mover 136 includes the pair of converters 150, but the present disclosure is not limited to this structure. For example, the multiple movers each including the converter 150 may be moved by respective feeders in the X direction to move the support member 134 in the light emission direction. Also in this case, the operational effects the same as those of the position adjuster 130 are obtained. In addition, distortion of the substrate resulting from position adjustment performed by the contact member on the substrate in the light emission direction is reduced while the contact member and the mover are kept in a good balance.

The exemplary embodiment includes a feed screw is used as an example of the feeder 142, but the present disclosure is not limited to this structure. The feeder 142 may be any member capable of moving the mover 136 in the X direction. For example, the feeder 142 may be formed from a spring or a cylinder.

In the exposure device and the image forming apparatus according to any of the exemplary embodiments, three light emitters are disposed on the substrate, but the present disclosure is not limited to this structure. For example, one, two, four, or more light emitters may be disposed on the substrate. The positions of multiple light emitters disposed on the substrate may be set as appropriate.

In the exposure device and the image forming apparatus according to any of the exemplary embodiments, the substrate is formed from a metal block, but the present disclosure is not limited to this structure. The material or shape of the substrate may be changed. For example, the substrate may be formed from resin, or another metal material such as sheet metal. Components of the light emitter or the shape of each component of the light emitter may be changed. The support body of the light emitter is formed from a metal block, but the present disclosure is not limited to this structure. The material or shape of the support body may be changed. For example, the support body may be formed from resin, or another metal material such as sheet metal.

The exposure device and the image forming apparatus according to any of the exemplary embodiments are usable for any of the following purposes to which photolithography is applied: forming a color filter in a process of manufacturing a liquid crystal display (LCD), exposing a dry film resist (DFR) to light in a process of manufacturing a thin film transistor (TFT), exposing a dry film resist (DFR) to light in a process of manufacturing a plasma display panel (PDP), exposing a photosensitive member such as a photoresist in a process of manufacturing a semiconductor device, exposing a photosensitive member such as a photoresist in a process of plate-making in printing such as photogravure printing other than offset printing, and exposing a photosensitive member to light in a process of manufacturing components of a timepiece. Photolithography indicates a technology of exposing a surface of an object on which a photosensitive member is placed to light into a pattern to generate a pattern including a portion exposed to light and a portion not exposed to light.

The exposure device and the image forming apparatus may employ either a photon-mode photosensitive member to which information is directly recorded with light exposure, and a heat-mode photosensitive member to which information is recorded with heat generated by light exposure. A light emitting diode (LED) or a laser element is usable as a light source of the image forming apparatus in accordance with an object that is to be exposed to light.

Although the present disclosure has been described in detail using specific exemplary embodiments, the present disclosure is not limited to the exemplary embodiments. It is obvious to those skilled in the art that the present disclosure may be embodied in various exemplary embodiments within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An exposure device comprising:

at least one light emitter that includes:

a substrate; and a light-emitting device disposed on the substrate; and a position adjuster that includes:

a contact member having an outer periphery in contact with the substrate;

a support member that rotatably supports the contact member; and at least one mover that is in contact with the support member to move the support member in a light emission direction of the light emitter, wherein the at least one mover is movable in a direction that is perpendicular to the light emission direction of the light emitter.

2. The exposure device according to claim 1, wherein a coefficient of friction between the contact member and the substrate is smaller than a coefficient of friction between the support member and the contact member.

3. The exposure device according to claim 2, wherein the substrate extends in a first direction, wherein the at least one light-emitting device includes a plurality of light-emitting devices disposed at a plurality of positions in the first direction, wherein the support member is a shaft, and wherein the position adjuster includes at least one receiving portion that receives the shaft while allowing the shaft to rotate about an axis extending in a direction perpendicular to the first direction and allowing the shaft to move in the light emission direction.

4. The exposure device according to claim 3, wherein the mover is movable in the first direction, and wherein the mover includes a converter that converts a moving force in the first direction into a moving force of moving the shaft in the light emission direction.

5. The exposure device according to claim 4, wherein the converter is at least one slope that is disposed at a portion of the mover in contact with the shaft and that is inclined with respect to the first direction.

6. The exposure device according to claim 5, wherein the at least one slope included in the mover includes a pair of slopes, and wherein the pair of slopes are in contact with both end portions of the shaft with the contact member in between.

7. The exposure device according to claim 4, wherein the at least one receiving portion includes receiving portions opposing each other in a cross direction of the substrate, wherein the opposing receiving portions receive the shaft, and wherein the contact member is disposed between the opposing receiving portions of the shaft.

8. The exposure device according to claim 3, wherein the at least one receiving portion includes receiving portions opposing each other in a cross direction of the substrate, wherein the opposing receiving portions receive the shaft, and wherein the contact member is disposed between the opposing receiving portions of the shaft.

9. The exposure device according to claim 1, wherein the substrate extends in a first direction, wherein the at least one light-emitting device includes a plurality of light-emitting devices disposed at a plurality of positions in the first direction, wherein the support member is a shaft, and wherein the position adjuster includes at least one receiving portion that receives the shaft while allowing the shaft to rotate about an axis extending in a direction perpendicular to the first direction and allowing the shaft to move in the light emission direction.

10. The exposure device according to claim 9, wherein the mover is movable in the first direction, and wherein the mover includes a converter that converts a moving force in the first direction into a moving force of moving the shaft in the light emission direction.

11. The exposure device according to claim 10, wherein the converter is at least one slope that is disposed at a portion of the mover in contact with the shaft and that is inclined with respect to the first direction.

12. The exposure device according to claim 11, wherein the at least one slope included in the mover includes a pair of slopes, and wherein the pair of slopes are in contact with both end portions of the shaft with the contact member in between.

13. The exposure device according to claim 10, wherein the at least one receiving portion includes receiving portions opposing each other in a cross direction of the substrate, wherein the opposing receiving portions receive the shaft, and wherein the contact member is disposed between the opposing receiving portions of the shaft.

14. The exposure device according to claim 9, wherein the at least one receiving portion includes receiving portions opposing each other in a cross direction of the substrate, wherein the opposing receiving portions receive the shaft, and wherein the contact member is disposed between the opposing receiving portions of the shaft.

15. The exposure device according to claim 9, wherein the at least one mover includes two movers arranged in a direction perpendicular to the first direction, and wherein the contact member is disposed between the two movers.

16. The exposure device according to claim 9, wherein the position adjuster includes a feeder that moves the mover in the first direction, and wherein the feeder and the contact member overlap each other in the light emission direction.

17. The exposure device according to claim 16, wherein the feeder is a screw member that extends in the first direction and moves the mover in the first direction by rotating about an axis, and wherein the position adjuster further includes a driving source that drives the screw member to rotate.

18. The exposure device according to claim 9, wherein a straight line that passes a contact point between the contact member and the substrate and a contact point between the mover and the shaft extends in the light emission direction.

19. The exposure device according to claim 1, wherein the contact member has an outer diameter larger than an outer diameter of a shaft serving as the support member.

20. An image forming apparatus, comprising:

an image carrier;

the exposure device according to claim 1 capable of exposing the image carrier to light to foiiii an electrostatic latent image, and adjusting a distance between the image carrier and a light-emitting device; and a developing device that develops the electrostatic latent image on the image carrier.

* * * * *